US008728696B2

(12) United States Patent
Yamada et al.

(10) Patent No.: US 8,728,696 B2
(45) Date of Patent: May 20, 2014

(54) TONER, IMAGE FORMING METHOD, AND PROCESS CARTRIDGE

(75) Inventors: Saori Yamada, Shizuoka (JP); Mitsuo Aoki, Shizuoka (JP); Hisashi Nakajima, Shizuoka (JP); Masashi Nagayama, Shizuoka (JP); Shigenori Yaguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/404,276

(22) Filed: Feb. 24, 2012

(65) Prior Publication Data

US 2012/0237868 A1 Sep. 20, 2012

(30) Foreign Application Priority Data

Mar. 14, 2011 (JP) ..... 2011-055166
Mar. 29, 2011 (JP) ..... 2011-071412
Apr. 1, 2011 (JP) ..... 2011-081887

(51) Int. Cl.
*G03G 9/00* (2006.01)

(52) U.S. Cl.
USPC ..... 430/109.4; 430/107.1; 430/108.1; 430/108.6; 430/108.24; 430/109.1; 430/123.52; 430/123.53; 430/123.57

(58) Field of Classification Search
USPC ..... 430/107.1, 108.1, 108.6, 108.24, 109.1, 430/123.57, 124.1, 123.52, 123.53, 109.4; 399/111
See application file for complete search history.

(56) References Cited

U.S. PATENT DOCUMENTS

| | | | | |
|---|---|---|---|---|
| 7,985,518 | B2 | 7/2011 | Shu et al. | |
| 2002/0151437 | A1* | 10/2002 | Ikemizu et al. | 503/227 |
| 2004/0096766 | A1* | 5/2004 | Urabe et al. | 430/109.4 |
| 2005/0100808 | A1* | 5/2005 | Hashimoto et al. | 430/108.8 |
| 2007/0275315 | A1* | 11/2007 | Nagatomo et al. | 430/108.1 |
| 2009/0142678 | A1 | 6/2009 | Yagi et al. | |
| 2010/0068644 | A1 | 3/2010 | Nakajima et al. | |
| 2010/0136471 | A1 | 6/2010 | Yamada et al. | |
| 2011/0165508 | A1 | 7/2011 | Nakayama et al. | |
| 2011/0170915 | A1 | 7/2011 | Aoki et al. | |
| 2012/0009514 | A1 | 1/2012 | Nagayama et al. | |
| 2012/0009518 | A1 | 1/2012 | Nagayama et al. | |

FOREIGN PATENT DOCUMENTS

| | | |
|---|---|---|
| CN | 101755241 A | 6/2010 |
| JP | 1-105962 | 4/1989 |
| JP | 5-289395 | 11/1993 |
| JP | 8-248719 | 9/1996 |
| JP | 8-248757 | 9/1996 |
| JP | 2000-56514 | 2/2000 |
| JP | 2005-134738 | 5/2005 |
| JP | 2005-256220 | 9/2005 |
| JP | 2006-220694 | 8/2006 |
| JP | 2009-209367 | 9/2009 |

* cited by examiner

*Primary Examiner* — Thorl Chea
(74) *Attorney, Agent, or Firm* — Oblon, Spivak, McClelland, Maier & Neustadt, L.L.P.

(57) ABSTRACT

A toner including a binder resin, a colorant, and a release agent is provided. The toner has a peak loss tangent (tan δ) value of 3 or more within a temperature range of 80 to 160° C. Here, the loss tangent (tan δ) is a ratio (G"/G') of a loss elastic modulus (G") to a storage elastic modulus (G'). The toner provides a good combination of low-temperature fixability, hot offset resistance, storage stability, coloring power and/or opacifying power, and gloss.

16 Claims, 4 Drawing Sheets

TONER, IMAGE FORMING METHOD, AND PROCESS CARTRIDGE

CROSS-REFERENCE TO RELATED APPLICATIONS

This patent application is based on and claims priority pursuant to 35 U.S.C. §119 to Japanese Patent Application Nos. 2011-055166, 2011-071412, and 2011-081887, filed on Mar. 14, 2011, Mar. 29, 2011, and Apr. 1, 2011, respectively, in the Japanese Patent Office, the entire disclosure of each which is hereby incorporated herein by reference.

TECHNICAL FIELD

The present disclosure relates to electrophotographic toner, image forming method, and process cartridge.

BACKGROUND

In electrophotography, a full-color image is formed with toners of four colors: three primary colors of yellow, magenta, and cyan, and black. A light beam reflected from a document is passed through a color separation light transmission filter having complementary colors to toners. The light beam is then directed to an image bearing member so that an electrostatic latent image is formed on a photosensitive layer of the image bearing member. The electrostatic latent image is developed into a single-color toner image, and the single-color toner image is transferred onto a recording medium. This process is successively repeated so that four single-color toner images of yellow, magenta, cyan and black are formed and superimposed on one another on the recording medium. The resulting composite full-color toner image is finally fixed on the recording medium.

In a typical electrophotographic image forming process as described above in which a full-color toner image is formed by superimposing multiple different-colored toner images, toners are required to have specific properties. For example, toners are required to exhibit proper gloss after being fixed on a recording medium while preventing the occurrence of diffuse reflection. Toners are also required to be transparent after being fixed on a recording medium so as not to disturb the color tone of underlying toner layers. Accordingly, toners for full-color printing are required to express greater gloss and transparency than toners for black-and-white printing. In particular, toners for full-color printing are required to express lower viscosity upon application of heat.

Additionally, toners are also required to be fixable at much lower temperatures in accordance with recent demands for energy-saving and high-speed printing. If the low-temperature fixing is achieved by merely reducing the melting point of toner, other problems arise. For example, such a toner may not be stably stored or may degrade a carrier in a two-component developer by contamination.

Generally, a full-color image formed of four color toner images is formed on a white recording medium. When formed on a colored or black paper or a transparent film, the full-color image expresses dull color. In attempting to solve this problem, Japanese Patent Application Publication No. 2006-220694 proposes to form a white background on a colored or black paper or a transparent film with a white toner.

The white toner layer as a background is required to have opacifying power. In other words, the white toner layer is required to completely scatter and reflect incident light to perfectly reproduce white color. When incident light can transmit the white toner layer, it means that opacifying power of the white toner layer is too poor to vividly reproduce a colored toner image formed thereon. Compared to colored or black toners that absorb light, white toners should be more precisely designed to express opacifying power.

To improve opacifying power, various attempts have been made. For example, Japanese Patent Application Publication No. 01-105962 describes a white toner including an aluminum oxide and/or silicon dioxide and Japanese Patent Application Publication No. 2000-56541 describes a white toner including a rutile type $TiO_2$, opacifying power of each of which may be insufficient.

On the other hand, there have been attempts to reproduce metallic texture with toner. For example, Japanese Patent Application Publication Nos. 08-248757 and 08-248719 describe a toner including a mixture of a typical yellow, magenta, or cyan colorant with a fluorescent or transparent powdery agent, for reproducing metallic texture. There may be a concern that the colorant and the fluorescent or transparent powdery agent are not uniformly mixed.

Japanese Patent Application Publication No. 2005-134738 describes a toner including a binder resin and a metallic pigment blended in a dry condition. There may be a concern that the binder resin and the metallic pigment are not uniformly mixed due to the charge difference therebetween. Japanese Patent Application Publication No. 05-289395 describes a metallic toner including a dispersing auxiliary agent which may contaminate and degrade a carrier in a two-component developer.

Japanese Patent Application Publication No. 2009-209367 describes a metallic toner including a metallic material. If the binder resin of this toner does not have sufficient ductility, the outermost surface of a resulting toner layer may not be smooth. Such a non-smooth rough outermost surface diffusely reflects light and prevents the light from reaching the metallic material, resulting in poor luminance and reflectance from the metallic material and poor reproducibility of metallic texture.

The same goes for fluorescent toners such as a toner described in Japanese Patent Application Publication No. 2005-256220. If the binder resin of a fluorescent toner including a fluorescent colorant does not have sufficient ductility, the outermost surface of a resulting toner layer may not be smooth. Such a non-smooth rough outermost surface diffusely reflects light and prevents the light from reaching the fluorescent colorant, resulting in poor luminance and reflectance from the fluorescent colorant and poor reproducibility of fluorescent color. Fluorescent toners are also influenced by the background color tone when its opacifying power is not proper.

SUMMARY

Exemplary aspects according to embodiments of the present invention are put forward in view of the above-described circumstances, and provide a novel toner that provides a good combination of low-temperature fixability, hot offset resistance, storage stability, coloring power and/or opacifying power, and gloss.

In one embodiment, a toner includes a binder resin, a colorant, and a release agent. The toner has a peak loss tangent (tan δ) value of 3 or more within a temperature range of 80 to 160° C. Here, the loss tangent (tan δ) is a ratio (G"/G') of a loss elastic modulus (G") to a storage elastic modulus (G').

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
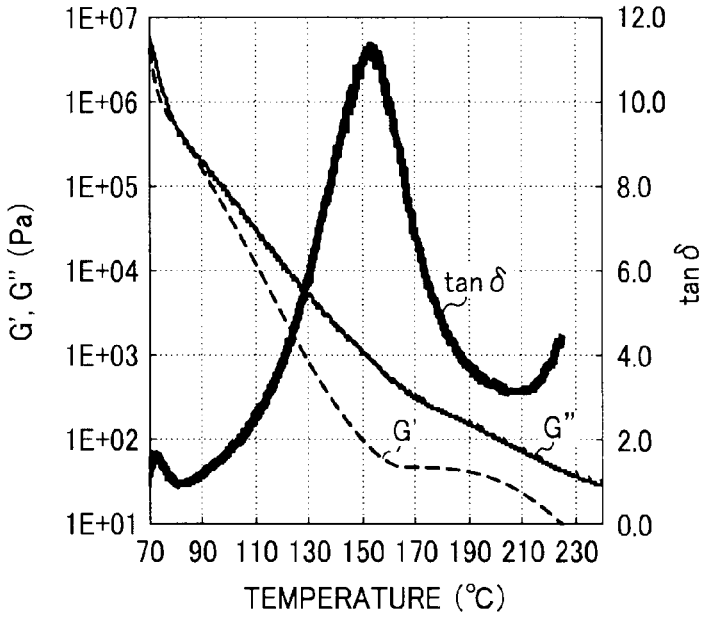
FIG. 1 is a graph showing viscoelastic properties of a toner according to an embodiment.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

A toner according to an embodiment includes a binder resin, a colorant, and a release agent. The toner has a peak loss tangent (tan δ) value of 3 or more within a temperature range of 80 to 160° C. Here, the loss tangent (tan δ) is the ratio (G"/G') of the loss elastic modulus (G") to the storage elastic modulus (G').

Generally, to make a toner fixable on a recording medium at low temperatures and express high gloss, the toner is designed to have a viscoelastic property such that the storage elasticity starts rapidly falling from a relatively low temperature. A toner designed to express a relatively low storage elastic modulus (G'), in other words, a relatively high plasticity, during the process of being fixed on a recording medium can get into micro concavities existing on a surface of a rough recording medium or an underlying toner layer. The toner thus fixed is unlikely to restore to its original granular state. Thus, such a toner having high ductility can form a smooth surface exhibiting high gloss.

On the other hand, to make a toner resistant to hot offset, the toner is designed to have a viscoelastic property such that the storage elastic modulus (G') falls only gradually after reaching a predetermined viscosity so that the viscosity is kept constant thereafter, and the loss elastic modulus (G") never rapidly falls as the storage elastic modulus (G') does. FIG. 1 is a graph showing viscoelastic properties of a toner according to an embodiment. As shown in FIG. 1, the loss tangent (tan δ) has a peak only when the storage elastic modulus (G') starts rapidly falling from a predetermined temperature but falls only gradually after reaching another predetermined temperature. According to an embodiment, the loss tangent (tan δ) has the maximum peak within a temperature range of 80 to 160° C.

When the loss tangent (tan δ) has a peak at a temperature less than 80° C., the toner is likely to aggregate when stored because the storage elastic modulus (G') undesirably falls. Additionally, hot offset resistance of the toner deteriorates because the viscoelasticity becomes too low at high temperatures. When the loss tangent (tan δ) has a peak at a temperature greater than 160° C., low-temperature fixability of the toner deteriorates.

When the maximum peak value of the loss tangent (tan δ) is too small, it means that the storage elastic modulus (G') does not fall as the loss elastic modulus (G") does. As a result, the toner cannot simultaneously achieve low-temperature fixability, hot offset resistance, and high gloss. According to an embodiment, to express high gloss, the loss tangent (tan δ) has a maximum peak value of 3 or more.

Generally, to express high gloss, the outermost surface of a toner layer should be as smooth as possible. To form a smooth outermost surface, a toner is generally required to express high ductility by reducing the storage elastic modulus (G'). Additionally, a toner layer is generally required to have compatibility with a surface supporting the toner layer.

Figure 2:
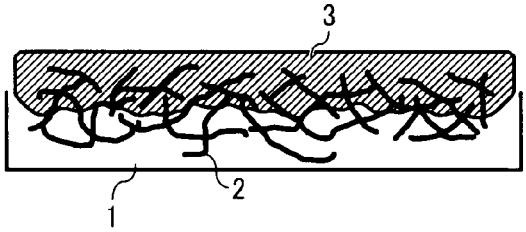
FIG. 2 is a view showing a toner layer directly fixed on paper.

FIG. 2 is a view showing a toner layer directly fixed on paper. A toner layer 3 fixed on a sheet of paper 1 has a relatively smooth outermost surface even when the toner has a relatively high storage elastic modulus (G'). This is because the paper absorbs elasticity of the toner owing to its plasticity or cellulose fibers 2 of the paper 1 absorb excessive toner particles when the toner layer 3 is fixed on the paper 1 upon application of pressure.

Figure 3:
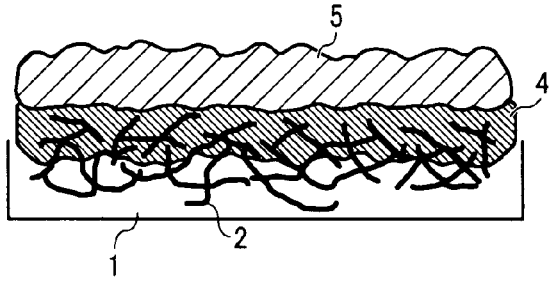
FIG. 3 is a view showing a toner layer fixed on another toner layer.

FIG. 3 is a view showing a toner layer fixed on another toner layer. For example, when a colored toner layer 5 (e.g., yellow, magenta, cyan, or black toner layer) is fixed on a white or metallic toner layer 4, the white or metallic toner layer 4 prevents the paper 1 from absorbing elasticity of the colored toner and also prevents the cellulose fibers 2 from absorbing excessive toner particles. Therefore, in FIG. 3, the colored toner layer 5 has a rough outermost surface.

Similarly, for example, when a fluorescent toner layer 5 is fixed on a colored toner layer 4 (e.g., yellow, magenta, cyan, or black toner layer), the colored toner layer 4 prevents the paper 1 from absorbing elasticity of the fluorescent toner and also prevents the cellulose fibers 2 from absorbing excessive toner particles. Therefore, in FIG. 3, the fluorescent toner layer 5 has a rough outermost surface.

Thus, it is severe to give proper gloss to a toner layer which is fixed on another toner layer. Additionally, when a toner has a relatively high storage elastic modulus (G'), the toner is likely to restore to the original granular state due to its elasticity even when applied with a pressure. As a result, a low-gloss undulating rough outermost surface is formed.

Figure 4:
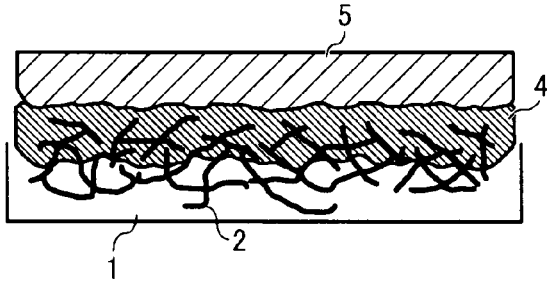
FIG. 4 is another view showing a toner layer fixed on another toner layer.

FIG. 4 is another view showing a toner layer fixed on another toner layer. In FIG. 4, at least one of the toner layers is formed of a toner according to an embodiment that has a viscoelastic property such that the loss tangent (tan δ) being the ratio (G"/G') of the loss elastic modulus (G") to the storage elastic modulus (G') has a maximum peak value of 3 or more. Because this toner predominately expresses ductility than elasticity, a toner layer 5 has a high-gloss smooth transparent outermost surface.

Because of having high ductility, a toner according to an embodiment is fixed on a recording medium while covering a large area thereof. Therefore, the toner can produce a high image density in a small amount. A white toner according to an embodiment expresses high opacifying power when fixed on a colored or black recording medium as a white background. A fluorescent toner according to an embodiment also expresses high opacifying power so as not to be influenced by the color tone of underlying layers.

Because of having high ductility, a metallic toner according to an embodiment can form a high-gloss smooth outermost surface. Therefore, the metallic pigment can express high reflectance.

The maximum peak temperature and the maximum peak value of the loss tangent (tan δ) mainly depend on viscoelasticity of the binder resin, and are variable by controlling melt-kneading conditions in toner manufacture process. The viscoelasticity of the binder resin depends on the softening point or chemical composition of the binder resin.

Loss tangent (tan δ) properties of a toner can be measured as follows. A toner in an amount of 0.8 g is formed into a disc with a die having a diameter of 20 mm upon application of a pressure of 30 MPa. The disc is set to a rheometer (ADVANCED RHEOMETRIC EXPANSION SYSTEM from TA Instruments) equipped with a parallel cone having a diameter of 20 mm, and is subjected to measurements of loss elastic modulus (G") and storage elastic modulus (G') to determine the maximum peak temperature and the maximum peak value of the loss tangent (tan δ). During the measurements, the frequency is set to 1.0 Hz, the heating rate is set to 2.0° C./min, the strain is set to 0.1% (under automatic strain control in which the acceptable minimum stress is 1.0 g/cm, the acceptable maximum stress is 500 g/cm, the maximum addition strain is 200%, and the strain accommodation is 200%), and the gap is set so that the force is within a range of 0 to 100 gm. Loss tangent (tan δ) values corresponding to storage elastic modulus (G') values of 10 or less are eliminated.

The toner according to an embodiment includes a binder resin, a release agent, and a colorant. The binder resin may include a crystalline polyester resin. The toner may further include various internal and external additives (e.g., a charge controlling agent).

Specific examples of usable binder resins include, but are not limited to, styrene-based resins (e.g., homopolymers and copolymers of styrene or styrene derivatives, such as polystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymer, styrene-methacrylate copolymer, styrene-methyl α-chloroacrylate copolymer, and styrene-acrylonitrile-acrylate copolymer), epoxy resin, vinyl chloride resin, rosin-modified maleic acid resin, phenol resin, polyethylene resin, polypropylene resin, petroleum resin, polyurethane resin, ketone resin, ethylene-ethyl acrylate copolymer, xylene resin, and polyvinyl butyral resin. These resins are not limited in production process and are obtainable by bulk polymerization, solution polymerization, emulsion polymerization, suspension polymerization, etc. In some embodiments, the binder resin includes a polyester resin. In some embodiments, the binder resin includes a polyester resin as a main component. Generally, polyester resins have better storage stability and low-temperature fixability compared to other resins.

The polyester resin can be obtained from a polycondensation reaction between an alcohol and a carboxylic acid. Specific examples of usable alcohols include, but are not limited to, glycols (e.g., ethylene glycol, diethylene glycol, triethylene glycol, propylene glycol), etherified bisphenols (e.g., 1,4-bis(hydroxymethyl)cyclohexane, bisphenol A), divalent alcohols, and tri- or more valent polyols. Specific examples of usable carboxylic acids include, but are not limited to, divalent organic acids (e.g., maleic acid, fumaric acid, phthalic acid, isophthalic acid, terephthalic acid, succinic acid, malonic acid) and tri- or more valent polycarboxylic acids (e.g., 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,4-butanetricarboxylic acid, 1,2,5-hexanetricarboxylic acid, 1,3-dicarboxyl-2-methylenecarboxypropane, 1,2,7,8-octanetetracarboxylic acid). In some embodiments, the polyester resin has a glass transition temperature (Tg) of 50 to 75° C.

In some embodiments, the binder resin includes a crystalline polyester resin. The crystalline polyester resin improves low-temperature fixability of the toner and provides high gloss even when the toner is fixed at low temperatures. In some embodiments, the toner includes the crystalline polyester resin in an amount of 1 to 25 parts by weight, or 1 to 15 parts by weight, based on 100 parts by weight of the binder resin. When the content of the crystalline polyester resin is too high, the toner may form an undesirable film thereof on an image bearing member (e.g., photoreceptor) and storage stability of the toner may deteriorate. Additionally, transparency of the toner may be poor.

The crystalline polyester resin can be obtained from, for example, a polycondensation reaction between (1) a polyvalent carboxylic acid comprised of a straight-chain unsaturated aliphatic dicarboxylic acid or a reactive derivative thereof (e.g., an acid anhydride, a lower alkyl ester acid halide having 1 to 4 carbon atoms) and (2) a polyvalent alcohol comprised of a straight-chain aliphatic diol. The polyvalent carboxylic acid may be used in combination with a small amount of another polyvalent carboxylic acid, if needed. A straight-chain unsaturated aliphatic dicarboxylic acid is more likely to form a crystalline structure compared to an aromatic dicarboxylic acid.

Specific examples of usable polyvalent carboxylic acids include, but are not limited to, (a) unsaturated aliphatic dicarboxylic acids having a branched chain, (b) saturated aliphatic polyvalent carboxylic acids (e.g., saturated aliphatic dicarboxylic acids, saturated aliphatic tricarboxylic acids), and (c) aromatic polyvalent carboxylic acids (e.g., aromatic dicarboxylic acids, aromatic tricarboxylic acids). In some embodiments, the content of the polyvalent carboxylic acid is 30% by mol or less, or 10% by mol or less, based on total carboxylic acids, within which the resulting polyester resin is given crystallinity.

Specific examples of polyvalent carboxylic acids which can be optionally used in combination include, but are not limited to, dicarboxylic acids (e.g., malonic acid, succinic acid, glutaric acid, adipic acid, suberic acid, sebacic acid, citraconic acid, phthalic acid, isophthalic acid, terephthalic acid) and tri- or more valent carboxylic acids (e.g., trimellitic anhydride, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,4-butanetricarboxylic acid, 1,2,5-hexanetricarboxylic acid, 1,3-dicarboxyl-2-methylenecarboxypropane, 1,2,7,8-octanetetracarboxylic acid).

The polyvalent alcohol may be used in combination with a small amount of another polyvalent alcohol such as an aliphatic branched-chain diol, a cyclic diol, and a tri- or more valent polyol, if needed, so long as the resulting polyester has crystallinity. Specific examples of polyvalent alcohols which can be optionally used in combination include, but are not limited to, 1,4-bis(hydroxymethyl)cyclohexane, polyethylene glycol, ethylene oxide adduct of bisphenol A, propylene oxide adduct of bisphenol A, and glycerin.

In some embodiments, the crystalline polyester resin has a narrow molecular weight distribution and a low molecular weight to improve low-temperature fixability of the toner. In some embodiments, the crystalline polyester resin has a softening point of 60 to 120° C. measured by a flowtester capillary rheometer CFT-100D (from Shimadzu Corporation).

Usable release agents are not limited to specific materials. Either a single material or a mixture of two or more materials can be used as the release agent. When multiple toner layers are superimposed on one another, the outermost toner layer is generally required to have hot offset resistance. The release agent makes the outermost toner layer easily release from a fixing member. Specific examples of usable release agents include, but are not limited to, aliphatic hydrocarbons (e.g., liquid paraffin, microcrystalline wax, natural paraffin, synthetic paraffin, polyolefin wax, and partial oxides, fluorides, and chlorides of the above materials), animal oils (e.g., beef tallow, fish oil), plant oils (e.g., palm oil, soybean oil, rapeseed oil, rice bran wax, carnauba wax), higher aliphatic alcohols and higher fatty acids (e.g., montan wax), fatty acid amides, fatty acid bisamides, metal soaps (e.g., zinc stearate, calcium stearate, magnesium stearate, aluminum stearate, zinc oleate, zinc palmitate, magnesium palmitate, zinc myristate, zinc laurate, zinc behenate), fatty acid esters, and polyvinylidene fluoride.

In some embodiments, the release agent is included inside the toner. In this case, the content of the release agent is 0.1 to 15 parts by weight, or 1 to 7 parts by weight, based on 100 parts by weight of the binder resin. The release agent included inside the toner gives high hot offset resistance and high fixing strength to the toner. Such a toner provides low-temperature fixability even when used in high-speed image forming apparatuses. When the content of the release agent is less than 0.1 parts by weight, offset is likely to occur. When the content of the release agent is greater than 15 parts by weight, the toner is likely to adhere to a carrier in a two-component developer, degrading the resulting image quality. In some embodiments, the release agent is included in a surface region of the toner. In this case, the content of the release agent is 0.001 to 1 part by weight, or 0.01 to 0.3 parts by weight, based on 100 parts by weight of the binder resin.

When the release agent is included inside the toner, it means that the release agent is contained within its mother particle and is not externally adhered to the surface of the mother particle. More specifically, the release agent is completely encapsulated by the mother particle without being exposed at the surface of the mother particle, or is uniformly dispersed within the mother particle with partially being exposed at the surface of the mother particle. When the release agent is included in a surface region of the toner, it means that that the release agent is adhered to the surface of the mother particle.

In some embodiments, the release agent includes a fatty acid amide. The fatty acid amide functions as not only a release agent but also a crystallizing agent in the toner, thereby improving storage stability of the toner. The fatty acid amide can be used in combination with other release agents so that the releasing and crystallizing functions are separately controlled in the toner. In some embodiments, the fatty acid amide is used in combination with a carnauba wax or a paraffin wax, each of which having high releasing power. Specific examples of usable fatty acid amides include, but are not limited to, stearic acid amide, oleic acid amide, erucic acid amide, ethylene-bis stearic acid amide, and N,N'-ethylene-bis stearic acid amide.

Usable colorants include, for example, black, magenta, cyan, yellow, white, metallic, and fluorescent colorants. Two or more of the following colorants can be used in combination.

Specific examples of usable black colorants include, but are not limited to, carbon blacks such as furnace black, lamp black (C. I. Pigment Black 7), acetylene black, and channel black; metals such as copper, iron (C. I. Pigment Black 11), and titanium oxide; and organic pigments such as aniline black (C. I. Pigment Black 1).

Specific examples of usable magenta colorants include, but are not limited to, C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C. I. Pigment Violet 19:C; and C. I. Vat Red 1, 2, 10, 13, 15, 23, 29, and 35.

Specific examples of usable cyan colorants include, but are not limited to, C. I. Pigment Blue 2, 3, 15, 15:1, 15:2, 15:3, 15:4, 15:6, 16, 17, and 60; C. I. Vat Blue 6; C. I. Acid Blue 45; copper phthalocyanine pigments having a phthalocyanine skeleton substituted with 1 to 5 phthalimidemethyl groups; and Green 7 and Green 35.

Specific examples of usable yellow colorants include, but are not limited to, C. I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, and 180; C. I. Vat Yellow 1, 3, and 30; and Orange 36.

In some embodiments, the content of the above-described colorants in black-and-white or full-color printing toners is 1 to 15% by weight or 3 to 10% by weight. When the colorant content is less than 1% by weight, coloring power of the toner may be poor. When the colorant content is greater than 15% by weight, coloring power and electric property of the toner may be poor because the colorant cannot be uniformly dispersed in the toner.

Specific examples of usable white colorants include, but are not limited to, metals (e.g., calcium carbonate, silica, zirconium oxide, zinc oxide, titanium oxide) and organic pigments (e.g., N,N-bis(4,6-1,3,5-triazine-2-yl)ethylenediamine). Organic pigments are advantageous, and N,N-bis(4,6-1,3,5-triazine-2-yl)ethylenediamine is more advantageous, in terms of dispersibility. Organic pigments are more dispersible in resins than inorganic pigments due to their relatively small specific weight. In particular, N,N-bis(4,6-1,3,5-triazine-2-yl)ethylenediamine has good dispersibility in polyester resins.

In some embodiments, the content of the above-described white colorants in the toner is 10 to 70% by weight or 20 to 50% by weight. When the white colorant content is less than 10% by weight, opacifying power of the toner may be poor. When the white colorant content is greater than 70% by weight, electric property of the toner may be poor because the colorant cannot be uniformly dispersed in the toner.

Specific examples of usable metallic colorants include, but are not limited to, metallic gold pigments, silver pigments, aluminum pigments, bronze pigments, gold bronze pigments, stainless steel pigments, zinc pigments, iron pigments, tin pigments, and copper pigments. One or more of these colorants can be used in combination.

Specific examples of commercially available gold bronze pigments include, but are not limited to, ROTOSAFE® 700 series and ROTOFLEX® XA series (4 to 10 μm) and LITHOFLEX® XA series (2.5 to 4 μm) from ECKART.

Specific examples of commercially available silver pigments include, but are not limited to, STAPA® 3000 series (4 to 8 μm), STAPA® 2000 series (6 to 10 μm), LITHOFLEX® ST 015 10 (3.5 to 4.5 μm), STANDART® 4000 series (2.5 to 3.5 μm), and STANDART® 3000 series (2.5 to 4 μm), all from ECKART. Specific examples of commercially available silver pigments further include, but are not limited to, DF-1667 (16 μm), DF-2750 (55 μm), DF-3500 (27 μm), DF-3622 (35 μm), DF-554 (15 μm), DF-L-520AR (20 μm), LED-1708AR (20 μm), LED-2314AR (13 μm), SILBERCOTE® PC 0452Z (55 μm), SILBERCOTE® PC 1291X (47 μm), SILBERCOTE® PC 3331X (36 μm), SILBERCOTE® PC 4352Z (31 μm), SILBERCOTE® PC 4852X (33 μm), SILBERCOTE® PC 6222X (20 μm), SILBERCOTE® PC 6352Z (27 μm), SILBERCOTE® PC 6802X (25 μm), SILBERCOTE® PC 8152Z (14 μm), SILBERCOTE® PC 8153X (14 μm), SILBERCOTE® PC 8602X (16 μm), SILVET®/SILVEX® 890 series (20 μm), and SILVET®/SILVEX® 950 series (16 μm), all from Silberline Manufacturing Co., Inc.

The following mica pigments covered with a metal oxide, all available from Merck KGaA, are also usable: IRIODIN® 300 Gold Pearl, IRIODIN® 100 Silver Pearl, TIMIRON® Bronze MP-60 (22 to 37 μm), TIMIRON® Copper MP-65 (22 to 37 μm), COLORONA® Oriental Beige (3 to 10 μm), COLORONA® Aborigine Amber (18 to 25 μm), COLORONA® Passion Orange (18 to 25 μm), COLORONA® Bronze Fine (7 to 14 μm), COLORONA® Bronze (18 to 25 μm), COLORONA® Bronze Sparkle (28 to 42 μm), COLORONA® Copper Fine (7 to 14 μm), COLORONA® Copper (18 to 25 μm), COLORONA® Copper Sparkle (25 to 39 μm), COLORONA® Red Brown (18 to 25 μm), COLORONA® Russet (18 to 25 μm), COLORONA® Tibetan Ochre (18 to 25 μm), COLORONA® Sienna Fine (7 to 14 μm), COLORONA® Sienna (18 to 25 μm), COLORONA® Bordeaux and COLORONA® Glitter Bordeaux (18 to 25 μm), and COLORONA® Chameleon (18 to 25 μm).

The following mica pigments covered with a metal oxide, all available from Merck KGaA, are also usable: TIMIRON® Super Silk MP-1005 (3 to 10 μm), TIMIRON® Super Sheen MP-1001 (7 to 14 μm), TIMIRON® Super Silver Fine (9 to 13 μm), TIMIRON® Pearl Sheen MP-30 (15 to 21 μm), TIMIRON® Satin MP-11171 (11 to 20 μm), TIMIRON® Ultra Luster MP-111 (18 to 25 μm), TIMIRON® Star Luster MP-111 (18 to 25 μm), TIMIRON® Pearl Flake MP-10 (22 to 37 μm), TIMIRON® Super Silver (17 to 26 μm), TIMIRON® Sparkle MP-47 (28 to 38 μm), TIMIRON® Arctic Silver (19 to 25 μm), XIRONA® Silver (15 to 22 μm), and RONASTAR® Silver (25 to 45 μm). The following special effect mica pigments having a size of about 18 to 50 μm, all available from ECKART, are also usable: DORADO® PX4001, DORADO® PX4261, DORADO® PX 4271, DORADO® PX4310, DORADO® PX4331, DORADO® PX4542, PHOENIX® XT, PHOENIX® XT2001, PHOENIX® XT3001, PHOENIX® XT4001, PHOENIX® XT5001, PHOENIX® PX1000, PHOENIX® PX1001, PHOENIX® PX1221, PHOENIX® PX1231, PHOENIX® PX1241, PHOENIX® PX1251, PHOENIX® PX1261, PHOENIX® PX1271, PHOENIX® PX1310, PHOENIX® PX1320, PHOENIX® PX1502, PHOENIX® PX1522, PHOENIX® PX1542, PHOENIX® PX2000, PHOENIX® PX2000L, PHOENIX® PX2001, PHOENIX® PX2011, PHOENIX® PX2021, PHOENIX® PX2221, PHOENIX® PX2231, PHOENIX® PX2241, PHOENIX® PX2251, PHOENIX® PX2261, PHOENIX® PX2271, PHOENIX® PX3001, PHOENIX® PX4000, PHOENIX® PX4001, PHOENIX® PX4221, PHOENIX® PX4231, PHOENIX® PX4241, PHOENIX® PX4251, PHOENIX® PX4261, PHOENIX® PX4271, PHOENIX® PX4310, PHOENIX® PX4320, PHOENIX® PX4502, PHOENIX® PX4522, PHOENIX® PX4542, PHOENIX® PX5000, PHOENIX® PX5001, PHOENIX® PX5310, and PHOENIX® PX5331.

In some embodiments, the content of the above-described metallic colorants in the toner is 5 to 70% by weight or 10 to 50% by weight. When the metallic colorant content is less than 5% by weight, coloring power and opacifying power of the toner may be poor. When the metallic colorant content is greater than 70% by weight, electric property of the toner may be poor because the colorant cannot be uniformly dispersed in the toner.

Specific examples of usable fluorescent colorants include, but are not limited to, Solvent Yellow 44; Solvent Orange 5 and 55; Solvent Red 49, 149 and 150; Solvent Blue 5; Solvent Green 7; Acid Yellow 3 and 7; Acid Red 53, 77, 87 and 92; Acid Blue 9; Basic yellow 1 and 40; Basic Red 1 and 13; Basic Violet 7, 10 and 110; Basic Orange 14 and 22; Basic Blue 7; Basic Green 1; Vat Red 41; Disperse Yellow 82, 121, 124, 184:1, 186, 199 and 216; Disperse Orange 11; Disperse Red 58, 239, 240, 345, 362 and 364; Disperse Blue 7, 56, 183, 155, 354 and 365; Disperse Violet 26, 27, 28, 35, 38, 46, 48, 57, 63, 77 and 97; Direct Yellow 85; Direct Orange 8 and 9; Direct Blue 22; Direct Green 6; and Fluorescent Brightening Agent 54, 135, 162 and 260.

Specific examples of usable fluorescent colorants further include, but are not limited to, dyes and pigments based on diaminostilbene, fluorescein, thioflavin, eosin, rhodamine B, coumarin derivatives, and imidazole derivatives. Fluorescent dyes may be blended with a resin, such as a melamine resin, to be used as pigments. Usable blending resins include, but are not limited to acrylic resins and olefin resins, which can prevent generation of formaldehyde.

Specific examples of commercially available fluorescent pigments include, but are not limited to, SX-100 series (e.g., SX-101 Red Orange, SX-103 Red, SX-104 Orange, SX-105 Lemon Yellow, SX-106 Orange Yellow, SX-117 Pink, SX-127 Rose, SX-137 Rubine, SX-147 Violet, SX-157 Blue Violet) and SX-1000 series (e.g., SX-1004 Orange, SX-1005 Lemon Yellow, SX-1007 Pink, SX-1037 Magenta), all from SINLOIHI Co., Ltd. Usable fluorescent pigments include both daylight fluorescent pigments and inorganic fluorescent pigments. Inorganic fluorescent pigments are able to store end emit light like luminous paints.

In some embodiments, the content of the above-described fluorescent colorants in the toner is 3 to 50% by weight or 5 to 20% by weight. When the fluorescent colorant content is less than 3% by weight, coloring power of the toner may be poor. When the white colorant content is greater than 50% by weight, electric property of the toner may be poor because the colorant cannot be uniformly dispersed in the toner.

The toner according to an embodiment may include a charge controlling agent. Specific examples of usable charge controlling agents include, but are not limited to, nigrosine and denatured products (e.g., a fatty acid metal salt), onium salts (e.g., a phosphonium salt), and lake pigments thereof; triphenylmethane dyes, and lake pigments and higher fatty acid metal salts thereof; diorganotin oxides (e.g., dibutyltin oxide, dioctyltin oxide, dicyclohexyltin oxide); diorganotin borates (e.g., dibutyltin borate, dioctyltin borate, dicyclohexyltin borate); organic metal complexes; chelate compounds; monoazo metal complexes; acetylacetone metal complexes; aromatic hydroxycarboxylic acid metal complexes; aromatic dicarboxylic acid metal complexes; and quaternary ammonium salts. Specific examples of usable charge controlling agents further include, but are not limited to, aromatic hydroxycarboxylic acids and aromatic mono- and poly-carboxylic acids, and metal salts, anhydrides, and esters thereof; and phenol derivatives such as bisphenol. Two or more of these materials can be used in combination.

In some embodiments, the content of the charge controlling agent is 0.1 to 10 parts by weight based on total weight of the binder resin. Toners other than black toners prefer colorless or transparent charge controlling agents because they do not disturb the color tone of the toner itself.

The toner according to an embodiment may include an external additive. Specific examples of usable external additives include, but are not limited to, abrasive agents (e.g., silica, TEFLON® powder, polyvinylidene fluoride powder, cerium oxide powder, silicon carbide powder, strontium titanate powder), fluidizers (e.g., titanium oxide powder, aluminum oxide powder), anti-aggregating agents, resin powders, conductive agents (e.g., zinc oxide powder, antimony oxide powder, tin oxide powder), and developability improvers (e.g., white or black fine particles having the opposite polarity). Two or more of these materials can be used in combination so that the toner is given resistance to developing stresses applied in idle running.

The toner may be used for a two-component developer. The two-component developer is comprised of a magnetic carrier and the toner. The magnetic carrier may be comprised of magnetic fine particles of, for example, spinel ferrites such as magnetite and γ-iron oxide; spinel ferrites containing one or more metals (e.g., Mn, Ni, Zn, Mg, Cu) other than iron; magnetoplumbite-type ferrites such as barium ferrite; and iron or alloy particles covered with an oxide layer. The magnetic carrier may have either granular, spherical, or acicular shape. Ferromagnetic particles, such as iron, are also usable when high magnetization is needed. In some embodiments, spinel ferrites such as magnetite and γ-iron oxide and magnetoplumbite-type ferrites such as barium ferrite are used in view of chemical stability. Specific examples of usable commercially available magnetic fine particles include, but are not limited to, MFL-35S and MFL-35HS (from Powdertech Co., Ltd.) and DFC-400M, DFC-410M and SM-350NV (from Dowa IP Creation Co., Ltd.).

Resin carriers containing ferromagnetic particles are also usable as the magnetic carrier. The magnetization of the resin carrier depends on the kind and content of the ferromagnetic particles therein. In some embodiments, the resin carrier has a magnetization of 30 to 150 emu/g in a magnetic field of 1,000 oersted. The resin carrier may be produced by, for example, spraying a melt-kneaded product of magnetic particles and an insulative binder resin, or alternatively, reacting or curing a monomer or prepolymer of a condensable binder resin in an aqueous medium in the presence of magnetic particles, so that the magnetic particles are dispersed in each binder resins.

Positively or negatively chargeable fine particles or conductive fine particles may be fixed to the surface of the magnetic carrier, or alternatively, a resin may be coated on the surface of the magnetic carrier, so as to control chargeability of the magnetic carrier. Specific examples of usable coating resins include, but are not limited to, silicone resin, acrylic resin, epoxy resin, and fluorocarbon resin. In particular, silicone resin and acrylic resin can be coated while containing the positively or negatively chargeable fine particles or conductive fine particles.

In some embodiments, the two-component developer to be stored in a developing device includes the magnetic carrier in an amount greater than 85% and less than 98% by weight. When the content of the magnetic carrier is less than 85% by weight, it is likely that toner particles scatter, causing defective images. When the content of the magnetic carrier is greater than 98% by weight, toner particles may be excessively charged or supplemental toner particles may be in short supply, causing defective images with a low image density.

The toner according to an embodiment may be produced by a pulverization method including: mixing the binder resin, the release agent, the colorant, and optional charge controlling agent and external additive, by a mixer such as a HENSCHEL MIXER or a SUPER MIXER; melt-kneading the mixture by a thermal melt-kneader such as a heating roller, a kneader, or an extruder; cooling and solidifying the melt-kneaded mixture; pulverizing the solidified mixture into particles; and classifying the particles by size. The solidified mixture may be pulverized into particles by, for example, a jet mill method in which a sample is brought into collision with a collision plate by a high-speed airflow, or a mechanical pulverization method in which a sample is supplied to a narrow gap between a high-speed rotor and a stator.

Alternatively, the toner according to an embodiment may be produced by a dissolution suspension method including: dissolving or dispersing the toner components in an organic solvent to prepare an oil phase; dispersing the oil phase in an aqueous medium while causing a resin-forming reaction; removing the organic solvent from the resulting emulsion; and filtering and drying the emulsion to obtain mother toner particles. Alternatively, the toner may be either produced by a polyester elongation method.

An electrophotographic image forming method according to an embodiment uses the above-described toner according to an embodiment. The electrophotographic image forming method includes a charging process in which an image bearing member is uniformly charged; an electrostatic latent image forming process (or an irradiating process) in which the charged image bearing member is irradiated with light containing image information so that an electrostatic latent image is formed thereon; a developing process in which the electrostatic latent image is developed into a toner image that is visible with the above-described toner according to an embodiment; a transfer process in which the toner image is transferred from the image bearing member onto a recording medium; and a fixing process in which the toner image is fixed on the recording medium. The electrophotographic image forming method may optionally include a cleaning process in which the image bearing member is cleaned after the transfer process and a neutralization process in which the image bearing member is neutralized after the transfer process. The electrophotographic image forming method is described in detail below with reference to accompany drawings.

Figure 5:
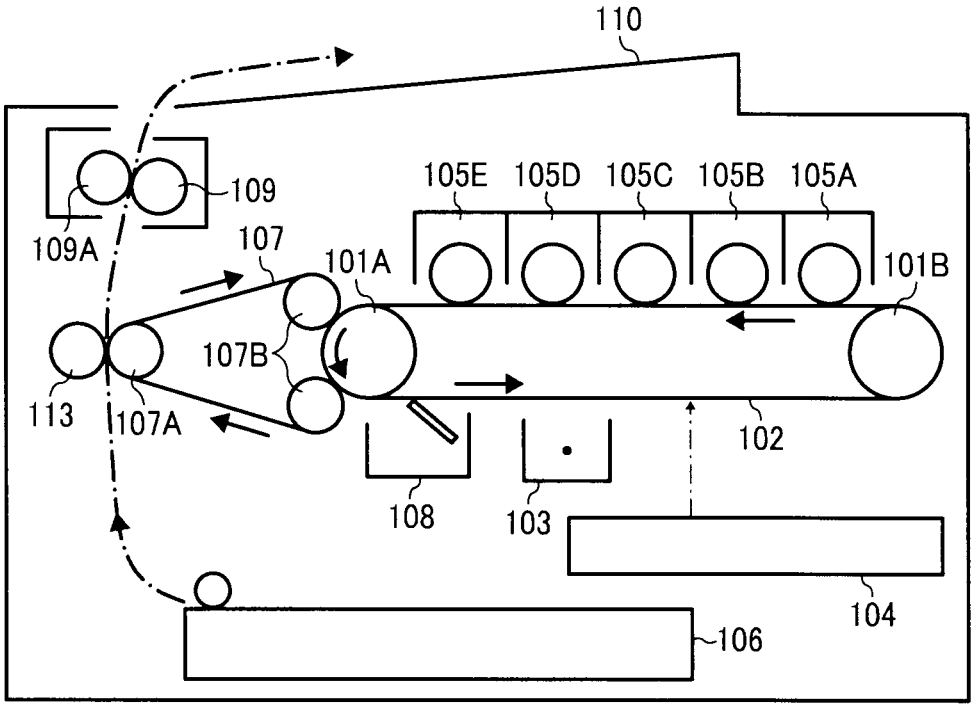
FIG. 5 is a schematic view illustrating an electrophotographic image forming apparatus according to an embodiment.

FIG. 5 is a schematic view illustrating an electrophotographic image forming apparatus according to an embodiment. The electrophotographic image forming apparatus includes a driving roller 101A, a driven roller 101B, a photoreceptor belt 102, a charger 103, a laser writing unit 104, developing units 105B, 105C, 105D, and 105E containing respective toners of yellow, magenta, cyan, and black, a developing unit 105E containing a white, metallic, or fluorescent toner, a paper feed cassette 106, an intermediate transfer belt 107, a driving axial roller 107A to drive the intermediate transfer belt 107, a pair of driven axial rollers 107B to support the intermediate transfer belt 107, a cleaner 108, a fixing roller 109, a pressing roller 109A, a paper ejection tray 110, and a paper transfer roller 113.

The electrophotographic image forming apparatus includes the intermediate transfer belt 107 that is flexible. The intermediate transfer belt 107 is stretched taut across the driving axial roller 107A and the pair of driven axial rollers 107B and is circularly conveyed clockwise in FIG. 5. A surface of the intermediate transfer belt 107 between the pair of driven axial rollers 107B is laterally in contact with the photoreceptor belt 102 on an outer periphery of the driving roller 101A.

In normal image forming operations, toner images formed on the photoreceptor belt 102 are each transferred onto the intermediate transfer belt 107 and superimposed on one another so that a full-color composite toner image is formed thereon. The paper transfer roller 113 transfers the composite toner image onto a transfer paper fed from the paper feed cassette 106. The transfer paper having the composite toner image thereon is fed to between the fixing roller 109 and the pressing roller 109A so that the composite toner image is fixed on the transfer paper by the fixing roller 109 and the pressing roller 109A. The transfer paper having the fixed toner image is ejected onto the paper ejection tray 110.

In the developing units 105A to 105E, the toner concentration in the developer decreases along with sequential development of electrostatic latent images into toner images. A toner concentration decrease is detected by a toner concentration detector. Upon detection of toner concentration decrease, a toner supplier connected to each developing units supplies toner to the connected developing unit so as to increase the toner concentration. When the developing units have a developer discharge mechanism, a mixture of carrier and toner, i.e., a trickle developer, may be supplied.

According to another embodiment, toner images may be directly transferred from a transfer drum onto a recording medium without using an intermediate transfer belt.

Figure 6:
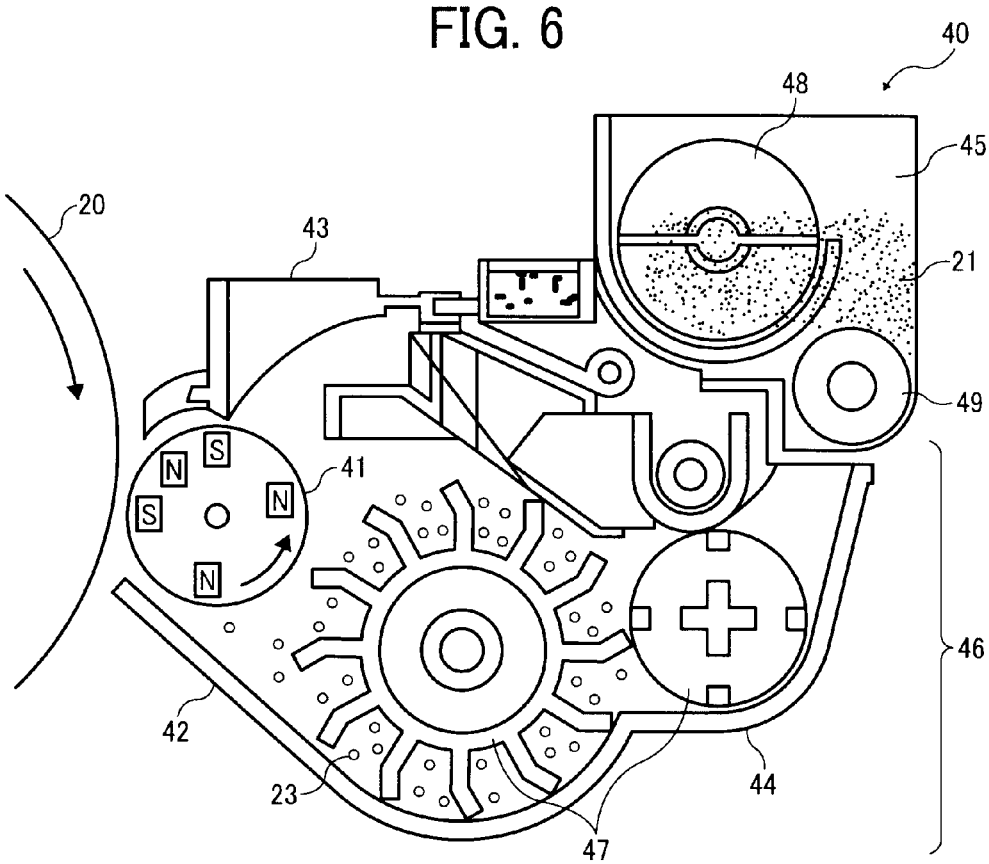
FIG. 6 is a schematic view illustrating a developing device according to an embodiment.

FIG. 6 is a schematic view illustrating a developing device according to an embodiment. A developing device 40 is disposed facing a photoreceptor 20 serving as an image bearing member. The developing device 40 includes a developing sleeve 41 serving as a developer bearing member, a developer container 42, a doctor blade 43 serving as a regulation member, and a support casing 44.

The support casing 44 has an opening on a side facing the photoreceptor 20. A toner hopper 45 serving as a toner container that contains toner particles 21 is attached to the support casing 44. A developer containing part 46 contains a developer comprising the toner particles 21 and carrier particles 23. A developer agitator 47 agitates the toner particles 21 and carrier particles 23 to frictionally charge the toner particles 21.

A toner agitator 48 and a toner supplying mechanism 49 each rotated by driving mechanisms are provided in the toner hopper 45. The toner agitator 48 and the toner supplying mechanism 49 agitate and supply the toner particles 21 in the toner hopper 45 toward the developer containing part 46.

The developing sleeve 41 is disposed within a space between the photoreceptor 20 and the toner hopper 45. The developing sleeve 41 is driven to rotate counterclockwise in FIG. 6 by a driving mechanism. The developing sleeve 41 internally contains a magnet serving as a magnetic field generator so that magnetic brushes are formed thereon from the carrier particles 23. The relative position of the magnet to the developing device 40 remains unchanged.

The doctor blade 43 is integrally provided to the developer container 42 on the opposite side of the support casing 44. A constant gap is formed between the tip of the doctor blade 43 and a circumferential surface of the developing sleeve 41.

In an electrophotographic image forming method according to an embodiment, the toner agitator 48 and the toner supplying mechanism 49 feed the toner particles 21 from the toner hopper 45 to the developer containing part 46. The developer agitator 47 agitates the toner particles 21 and the carrier particles 23 to frictionally charge the toner particles 21. The developing sleeve 41 bears the charged toner particles 21 and the carrier particles 23, and rotationally conveys them to a position where the developing sleeve 41 faces an outer peripheral surface of the photoreceptor 20. The toner particles 21 then electrostatically bind to an electrostatic latent image formed on the photoreceptor 20. Thus, a toner image is formed on the photoreceptor 20.

Figure 7:
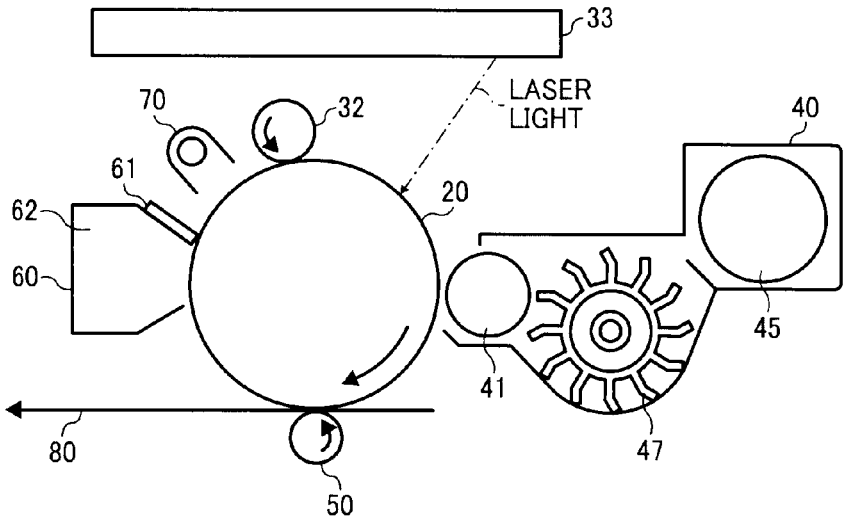
FIG. 7 is a schematic view illustrating an image forming apparatus including the developing device illustrated in FIG. 6.

FIG. 7 is a schematic view illustrating an image forming apparatus including the developing device illustrated in FIG. 6. Around the photoreceptor 20, a charging member 32, an irradiator 33, the developing device 40, a transfer member 50, a cleaning device 60, and a neutralization lamp 70 are provided. A gap of about 0.2 mm is formed between a surface of the charging member 32 and a surface of the photoreceptor 20. A voltage supplying mechanism supplies the charging member 32 with an electric filed in which an alternating current component is overlapped with a direct current component so that the photoreceptor 20 is uniformly charged.

This image forming apparatus employs a negative-positive image forming process. The photoreceptor 20 having an organic photoconductive layer is neutralized by the neutralization lamp 70, and then negatively charged by the charging member 32. The charged photoreceptor 20 is irradiated with laser light emitted from the irradiator 33 so that an electrostatic latent image is formed thereon. In this embodiment, the absolute potential value of the irradiated portion is lower than that of the non-irradiated portion.

The laser light is emitted from a semiconductive laser. A polygon mirror that is a polygonal columnar mirror rotating at a high speed scans the surface of the photoreceptor 20 with the laser light in the axial direction. The electrostatic latent image thus formed is then developed into a toner image with a developer comprised of toner and carrier particles supplied to a developing sleeve 41 in the developing device 40. When developing an electrostatic latent image, a voltage supplying mechanism supplies a developing bias that is a predetermined direct current voltage or that overlapped with an alternating current voltage, to between the developing sleeve 41 and the irradiated and non-irradiated portions on the photoreceptor 20.

On the other hand, a transfer medium 80 (e.g., paper) is fed from a paper feed mechanism. A pair of registration rollers feeds the transfer medium 80 to a gap between the photoreceptor 20 and the transfer member 50 in synchronization with an entry of the toner image to the gap so that the toner image is transferred onto the transfer medium 80. When transferring a toner image, a transfer bias that is a voltage having the opposite polarity to the toner charge is applied to the transfer member 50. Thereafter, the transfer medium 80 having the transferred toner image thereon separates from the photoreceptor 20.

Toner particles remaining on the photoreceptor 20 are removed by a cleaning blade 61 and collected in a toner collection chamber 62 in the cleaning device 60. The collected toner particles may be refer to the developer containing part 46 and/or the toner hopper 45 by a recycle mechanism so as to be recycled.

The image forming apparatus may include multiple developing devices. In this case, multiple toner images are sequentially transferred onto a transfer medium to form a composite toner image, and the composite toner image is finally fixed on the transfer medium. The image forming apparatus may further include and an intermediate transfer member. In this case, multiple toner images are transferred onto the intermediate transfer member to form a composite toner image, and the composite toner image is then transferred onto and fixed on a transfer medium.

Figure 8:
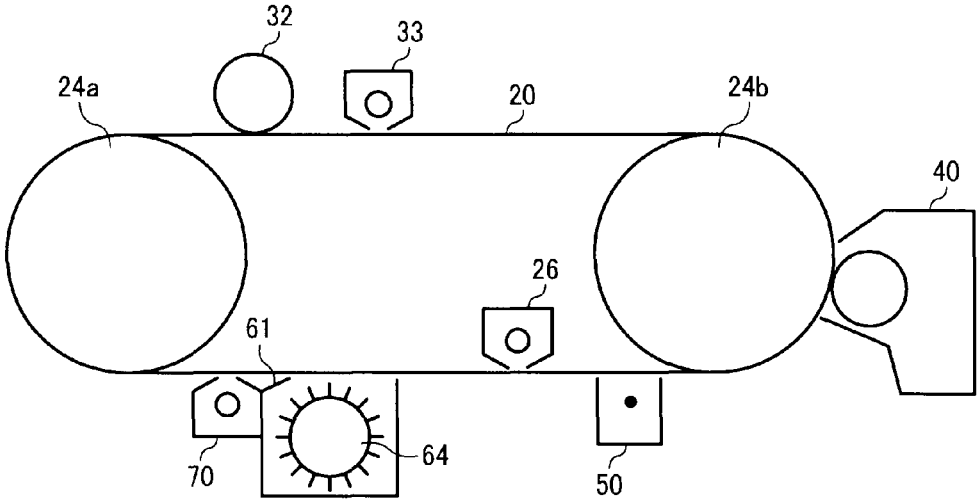
FIG. 8 is a schematic view illustrating an image forming apparatus according to another embodiment.

FIG. 8 is a schematic view illustrating an image forming apparatus according to another embodiment. In FIG. 8, a photoreceptor 20 includes a conductive substrate and a photosensitive layer disposed thereon. The photoreceptor 20 is driven by driving rollers 24*a* and 24*b*. The photoreceptor 20 is repeatedly subjected to the processes of charging by a charging member 32, irradiation by an irradiator 33, development by a developing device 40, transfer by a transfer member 50, pre-cleaning irradiation by a light source 26, cleaning by a cleaning brush 64 and a cleaning blade 61, and neutralization by a neutralization lamp 70. In the pre-cleaning irradiation process, light is emitted from the back side of the photoreceptor 20. Therefore, in this embodiment, the conductive substrate is translucent.

Figure 9:
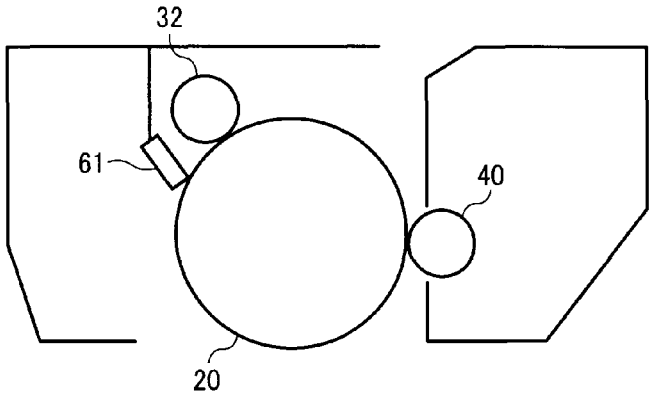
FIG. 9 is a schematic view illustrating a process cartridge according to an embodiment.

FIG. 9 is a schematic view illustrating a process cartridge according to an embodiment. The process cartridge integrally supports a photoreceptor 20, a charging member 32, a developing device 40 containing the developer according to an embodiment, and a cleaning blade 61. The process cartridge is detachably attachable to image forming apparatuses.

A process cartridge according to an embodiment integrally supports at least an image bearing member and a developing device that develops an electrostatic latent image formed on the image bearing member into a toner image with the toner or developer according to an embodiment, while being detachably attachable to an image forming apparatuses.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Polyester Resins A1 to A6

A 5-liter autoclave equipped with a distillation column is charged with 4,000 g of alcohol and carboxylic acid monomers according to the composition described in Table 1. The monomers are subjected to an esterification reaction at 170 to 260° C. under normal pressure without catalyst. After further adding antimony trioxide in an amount of 400 ppm based on total weight of the carboxylic acid monomers, the monomers are subjected to a polycondensation at 250° C. under vacuum at 3 Torr while removing the produced glycol. Thus, polyester resins A1 to A6 are prepared. The cross-linking reaction lasts until the agitation torque becomes 10 kg·cm (100 ppm). The reaction is terminated by breaking the reduced pressure condition.

TABLE 1

| Polyester Resin No. | | A1 | A2 | A3 | A4 | A5 | A6 |
|---|---|---|---|---|---|---|---|
| Alcohol Components (mol %) | BPA-PO* | 55 | — | — | 57 | 70 | — |
| | BPA-EO** | — | 55 | 35 | — | — | 30 |
| | Ethylene Glycol | 40 | 40 | 55 | 38 | 30 | 50 |
| | Glycerin | 5 | 5 | 10 | 5 | — | 20 |
| Carboxylic Acid Components (mol %) | Adipic Acid | 5 | 5 | 30 | — | — | 35 |
| | Terephthalic Acid | 55 | 55 | 40 | 55 | 45 | 35 |
| | Isophthalic Acid | 40 | 40 | 30 | 40 | 40 | 30 |
| | Itaconic Acid | — | — | — | — | — | — |
| | Trimellitic Acid | — | — | — | 5 | 15 | — |
| Properties | Softening Point (° C.) | 122.5 | 120.8 | 107.4 | 128.1 | 139.2 | 103.5 |
| | Glass Transition Temperature (° C.) | 62.4 | 60.3 | 53.4 | 67.9 | 73.4 | 47.7 |
| | Loss Tangent Peak Temperature (° C.) | 140 | 137 | 82 | 162 | No peak | 78 |
| | Loss Tangent Peak Value | 22 | 26 | 16 | 15 | — | 14 |
| | Acid Value (mgKOH/g) | 7.2 | 6.8 | 5.4 | 8.4 | 8.9 | 4.8 |
| | Weight Average Molecular Weight (Mw) | 20480 | 19840 | 15840 | 27750 | 34310 | 14270 |
| | Number Average Molecular Weight (Mn) | 4340 | 3580 | 3050 | 4820 | 5340 | 2840 |
| | Mw/Mn | 4.7 | 5.5 | 5.2 | 5.8 | 6.4 | 5.0 |

*BPA-PO: Polyoxypropylene (2,2)-2,2-bis(4-hydroxyphenyl) propane
**BPA-EO: Polyoxyethylene (2,2)-2,2-bis(4-hydroxyphenyl) propane

Evaluations of Polyester Resins A 1 to A6

The polyester resins A1 to A6 (hereinafter "samples") are subjected to evaluations in terms of softening point, glass transition temperature, loss tangent peak temperature, loss tangent peak value, acid value, number average molecular weight (Mn), and weight average molecular weight (Mw), as follows. The results are shown in Table 1.

Measurement of Softening Point

The softening point is determined using a flowtester CFT-500D (from Shimadzu Corporation). Each of the samples in an amount of 1 g is heated at a heating rate of 6° C./min while compressed with a load of 1.96 MPa from a plunger so that the sample is extruded from a nozzle having a diameter of 1 mm and a length of 1 mm, while compiling the correlation between the amount of decent of the plunger and temperature. The softening point is determined from a temperature at which the half amount of the sample has flowed out.

Measurement of Glass Transition Temperature

The glass transition temperature is determined using a differential scanning calorimeter DSC210 (from Seiko Instruments Inc.). Each of the samples in an amount of 0.01 to 0.02 g is contained in an aluminum pan, and heated to 200° C., cooled to 0° C. at a cooling rate of 10° C./min, and reheated at a heating rate of 10° C./min, to obtain an endothermic curve. The glass transition temperature is determined from an intersection temperature of a baseline at or below the maximum endothermic peak temperature with a tangent line indicating the maximum slope between the rising point and top of the maximum endothermic peak.

Measurement of Acid Value

The acid value is determined based on a method according to JIS K0070 except for replacing the described mixed solvent of ethanol and ether with another mixed solvent of acetone and toluene at a volume ratio of 1:1.

Measurement of Loss Tangent Peak Temperature and Value

The loss tangent peak temperature and value are determined using a rheometer ADVANCED RHEOMETRIC EXPANSION SYSTEM (from TA Instruments) equipped with a parallel cone having a diameter of 20 mm. Each of the samples in an amount of 0.8 g is formed into a disc using a die having a diameter of 20 mm upon application of a pressure of 30 MPa. The disc is subjected to measurements of loss elastic modulus (G"), storage elastic modulus (G'), and loss tangent (tan δ) while setting the frequency to 1.0 Hz, the heating rate to 2.0° C./min, the strain to 0.1% (under automatic strain control in which the acceptable minimum stress being 1.0 g/cm, the acceptable maximum stress being 500 g/cm, the maximum addition strain being 200%, and the strain accommodation being 200%), and the gap so that the force is variable within a range of 0 to 100 gm. Loss tangent (tan δ) values corresponding to storage elastic modulus (G') values of 10 or less are eliminated.

Measurement of Molecular Weight

The number average molecular weight (Mn) and weight average molecular weight (Mw) are determined using a gel permeation chromatography instrument GPC-150C (from Waters) equipped with columns SHOWDEX® KF801 to 8067 (from Showa Denko K.K.) as follows. After stabilizing the columns in a heat chamber at 40° C., THF is flowed therein at a flow rate of 1 ml/min. Each of the samples in an amount of 0.05 g is dissolved in THF and filtered with a pretreatment filter (CHROMATODISC from Kurabo Industries Ltd., having a pore size of 0.45 μm) to obtain a sample THF solution having a sample concentration of 0.05 to 0.6% by weight. The sample THF solution in an amount of 50 to 200 μl is injected to the instrument. The number average molecular weight (Mn) and weight average molecular weight (Mw) are determined from the resulting molecular weight distribution with reference to a calibration curve compiled from several kinds of monodisperse polystyrene standard samples.

The calibration curve may be complied from, for example, about 10 polystyrene standard samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, available from Pressure Chemical Company or Tosoh Corporation. A refractive index detector is used as the detector.

Preparation of Crystalline Polyester Resins B1 and B2

A 5-liter four-necked round-bottom flask equipped with a thermometer, a stirrer, a condenser, and a nitrogen inlet pipe is charged with 4,000 g of alcohol and carboxylic acid monomers according to the composition described in Table 2 and 4 g of hydroquinone. The flask is heated in a mantle heater while introducing nitrogen gas into the flask from the nitrogen inlet pipe to form an inert atmosphere within the flask. The monomers in the flask are kept heated at 160° C. for 5 hours, subsequently reacted at 200° C. for 1 hour, and further reacted at 8.3 kPa for 1 hour. Thus, crystalline polyester resins B1 and B2 are prepared.

TABLE 2

| | Crystalline Polyester Resin No. | B1 | B2 |
|---|---|---|---|
| Alcohol Components | 1,4-Butanediol | 100 | — |
| | 1,5-Pentanediol | — | 90 |
| (mol %) | 1,6-Hexanediol | — | 10 |
| Carboxylic Acid Components (mol %) | Fumaric Acid | 90 | — |
| | Succinic Acid | 5 | 5 |
| | Trimellitic Acid | 5 | 5 |
| | Terephthalic Acid | — | 90 |
| Properties | Melting Point (° C.) | 105 | 135 |
| | Weight Average Molecular Weight (Mw) | 6370 | 10450 |
| | Number Average Molecular Weight (Mn) | 1510 | 3860 |

Evaluations of Crystalline Polyester Resins B1 and B2

The crystalline polyester resins B1 and B2 (hereinafter "samples") are subjected to evaluations in terms of melting point, number average molecular weight (Mn), and weight average molecular weight (Mw), as follows. The results are shown in Table 2

Measurement of Melting Point

The melting point is determined using a differential scanning calorimeter DSC210 (from Seiko Instruments Inc.). Each of the samples in an amount of 0.01 to 0.02 g is contained in an aluminum pan, and heated to 150° C. at a heating rate of 15° C./min, to obtain an endothermic curve. The melting point is determined from the maximum endothermic peak temperature.

Measurement of Molecular Weights

The molecular weights of the crystalline polyester resins are measured in the same manner as those of the polyester resins as described above.

Preparation of White Toners

Each composition of polyester resins, crystalline polyester resins, release agents, and colorants at a ratio described in Table 3 are mixed by a HENSCHEL MIXER MF20C/I (from Nippon Coke & Engineering Co., Ltd.). The mixture is kneaded with a twin screw extruder (from Toshiba Machine Co., Ltd.). The kneaded mixture is cooled on a steel belt and pulverized into coarse particles of 200 to 300 μm by a hammer mill. The coarse particles are further pulverized into fine particles having a weight average particle diameter of 5.2±0.3 μm by an ultrasonic jet pulverizer LABOJET (from Nippon Pneumatic Mfg. Co., Ltd.) while controlling the pulverizing air pressure. The fine particles are subjected to a classification by an airflow classifier MDS-I (from Nippon Pneumatic Mfg. Co., Ltd.) while controlling the louver opening. Thus, mother toner particles having a weight average particle diameter of 6.0±0.2 μm and a ratio of the weight average particle diameter to the number average particle diameter of 1.20 or less are prepared. The mother toner particles in an amount of 100 parts are mixed with 1.0 part of an additive HDK-2000 (from Clariant) and 1.0 part of another additive H05TD (from Clariant) by a HENSCHEL MIXER. Thus, white toners W1 to W26 are prepared. In Table 3, "Carnauba Wax" represents Carnauba Wax No. 1 from CERARICA NODA Co., Ltd., "Fatty Acid Amide" represents N,N'-ethylene-bis stearic acid amide, "Organic Pigment" represents N,N-bis(4,6-1,3,5-triazine-2-yl)ethylenediamine, and "Inorganic Pigment" represents a titanium oxide R50-2 from Ishihara Sangyo Kaisha, Ltd.

TABLE 3

(part by weight)

| White Toner No. | Polyester Resins A1 | A2 | A3 | A4 | A5 | A6 | Crystalline Polyester Resins B1 | B2 | Release Agents Carnauba Wax (1) | Fatty Acid Amide (2) | Colorants Organic Pigment (3) | Inorganic Pigment (4) |
|---|---|---|---|---|---|---|---|---|---|---|---|---|
| W1 | 100 | | | | | | | | 5 | | 50 | |
| W2 | | 100 | | | | | | | 5 | | 50 | |
| W3 | | | 100 | | | | | | 5 | | 50 | |
| W4 | 80 | | | | | | 20 | | 5 | | 50 | |
| W5 | 80 | | | | | | 20 | | 5 | 3 | 50 | |
| W6 | 80 | | | | | | | 20 | 5 | 3 | 50 | |
| W7 | 90 | | | | | | 10 | | 5 | 3 | 50 | |
| W8 | | 80 | | | | | 20 | | 5 | 3 | 50 | |
| W9 | | | 80 | | | | 20 | | 5 | 3 | 50 | |
| W10 | | | | 80 | | | 20 | | 5 | 3 | 50 | |
| W11 | | | 60 | | 20 | | 20 | | 5 | 3 | 50 | |
| W12 | 80 | | | | | | 20 | | 5 | 3 | 250 | |
| W13 | 80 | | | | | | 20 | | 5 | 3 | 13 | |
| W14 | 100 | | | | | | | | 5 | | | 50 |
| W15 | 80 | | | | | | 20 | | 5 | | | 50 |
| W16 | 80 | | | | | | 20 | | 5 | 3 | | 50 |
| W17 | | | 60 | | 20 | | 20 | | 5 | 3 | | 50 |
| W18 | | | | 100 | | | | | 5 | | 50 | |
| W19 | | | | | 100 | | | | 5 | | 50 | |
| W20 | | | | | | 100 | | | 5 | | 50 | |
| W21 | | | | | 80 | | 20 | | 5 | 3 | 50 | |
| W22 | | | | | | 80 | 20 | | 5 | 3 | 50 | |
| W23 | | | 40 | | 40 | | 20 | | 5 | 3 | 50 | |
| W24 | | | | 100 | | | | | 5 | | | 50 |
| W25 | | | 40 | | 40 | | 20 | | 5 | 3 | | 50 |

(1) Carnauba Wax No. 1 from CERARICA NODA Co., Ltd.
(2) N,N'-ethylene-bis stearic acid amide
(3) N,N-bis(4,6-1,3,5-triazine-2-yl) ethylenediamine
(4) a titanium oxide R50-2 from Ishihara Sangyo Kaisha, Ltd.

Preparation of Black and Cyan Master Batches

A carbon black REGAL® 400R (from Cabot Corporation) in an amount of 50 parts, a polyester resin RS801 (from Sanyo Chemical Industries, Ltd.) in an amount of 50 parts, and water in an amount of 30 parts are mixed by a HENSHEL MIXER (from Nippon Coke & Engineering Co., Ltd.). The mixture is kneaded at 160° C. for 50 minutes by a twin roll. The kneaded mixture is rolled and cooled, and the rolled mixture is pulverized into particles. Thus, a black master batch is prepared. A cyan master batch is prepared in the same manner except for replacing the carbon black with C. I. Pigment Blue 15:3.

Preparation of Black and Cyan Toners

Each composition of polyester resins, crystalline polyester resins, release agents, and colorants at a ratio described in Table 4 are mixed by a HENSCHEL MIXER MF20C/I (from Nippon Coke & Engineering Co., Ltd.). The mixture is kneaded with a twin screw extruder (from Toshiba Machine Co., Ltd.). The kneaded mixture is cooled on a steel belt and pulverized into coarse particles of 200 to 300 μm by a hammer mill. The coarse particles are further pulverized into fine particles having a weight average particle diameter of 5.2±0.3 μm by an ultrasonic jet pulverizer LABOJET (from Nippon Pneumatic Mfg. Co., Ltd.) while controlling the pulverizing air pressure. The fine particles are subjected to a classification by an airflow classifier MDS-I (from Nippon Pneumatic Mfg. Co., Ltd.) while controlling the louver opening. Thus, mother toner particles having a weight average particle diameter of 6.0±0.2 μm and a ratio of the weight average particle diameter to the number average particle diameter of 1.20 or less are prepared. The mother toner particles in an amount of 100 parts are mixed with 1.0 part of an additive HDK-2000 (from Clariant) and 1.0 part of another additive H05TD (from Clariant) by a HENSCHEL MIXER. Thus, black toners Bk1 to Bk10 and cyan toners C1 to C10 are prepared. In Table 4, "Carnauba Wax" represents Carnauba Wax No. 1 from CERARICA NODA Co., Ltd. and "Fatty Acid Amide" represents N,N'-ethylene-bis stearic acid amide.

TABLE 4

(part by weight)

| Black or Cyan Toner No. | Polyester Resins A1 | A2 | A3 | A4 | A5 | A6 | Crystalline Polyester Resins B1 | B2 | Release Agents Carnauba Wax (1) | Fatty Acid Amide (2) | Colorants Black Master Batch | Cyan Master Batch |
|---|---|---|---|---|---|---|---|---|---|---|---|---|
| Bk1 | 100 | Z | | | | | | Z | 4 | | 16 | |
| Bk2 | 80 | | | | | | 20 | | 5 | | 16 | |
| Bk3 | 80 | | | | | | 20 | | 5 | 3 | 16 | |
| Bk4 | | | 80 | | | | 20 | | 5 | 3 | 16 | |
| Bk5 | | | | 80 | | | 20 | | 5 | 3 | 16 | |

TABLE 4-continued

| Black or Cyan Toner | Polyester Resins | | | | | | Crystalline Polyester Resins | | Release Agents | | (part by weight) Colorants | |
|---|---|---|---|---|---|---|---|---|---|---|---|---|
| No. | A1 | A2 | A3 | A4 | A5 | A6 | B1 | B2 | Carnauba Wax (1) | Fatty Acid Amide (2) | Black Master Batch | Cyan Master Batch |
| Bk6 | | | 60 | | 20 | | 20 | | 5 | 3 | 16 | |
| Bk7 | | | | 100 | | | | | 4 | | 16 | |
| Bk8 | | | | | 80 | | 20 | | 5 | 3 | 16 | |
| Bk9 | | | | | | 80 | 20 | | 5 | 3 | 16 | |
| Bk10 | | | 40 | | 40 | | 20 | | 5 | 3 | 16 | |
| C1 | 100 | | | | | | | | 4 | | | 16 |
| C2 | 80 | | | | | | 20 | | 5 | | | 16 |
| C3 | 80 | | | | | | 20 | | 5 | 3 | | 16 |
| C4 | | | 80 | | | | 20 | | 5 | 3 | | 16 |
| C5 | | | | 80 | | | 20 | | 5 | 3 | | 16 |
| C6 | | | 60 | | 20 | | 20 | | 5 | 3 | | 16 |
| C7 | | | | 100 | | | | | 4 | | | 16 |
| C8 | | | | | 80 | | 20 | | 5 | 3 | | 16 |
| C9 | | | | | | 80 | 20 | | 5 | 3 | | 16 |
| C10 | | | 40 | | 40 | | 20 | | 5 | 3 | | 16 |

(1) Carnauba Wax No. 1 from CERARICA NODA Co., Ltd.
(2) N,N'-ethylene-bis stearic acid amide Preparation of Gold Toners Each composition of polyester resins, crystalline polyester resins, release agents, and colorants at a ratio described in Table 5-1 are mixed by a HENSCHEL MIXER MF20C/I (from Nippon Coke & Engineering Co., Ltd.). The mixture is kneaded with a twin screw extruder (from Toshiba Machine Co., Ltd.). The kneaded mixture is cooled on a steel belt and pulverized into coarse particles of 200 to 300 μm by a hammer mill. The coarse particles are further pulverized into fine particles having a weight average particle diameter of 14.2±0.3 μm by an ultrasonic jet pulverizer LABOJET (from Nippon Pneumatic Mfg. Co., Ltd.) while controlling the pulverizing air pressure. The fine particles are subjected to a classification by an airflow classifier MDS-I (from Nippon Pneumatic Mfg. Co., Ltd.) while controlling the louver opening. Thus, mother toner particles having a weight average particle diameter of 15.0±0.2 μm and a ratio of the weight average particle diameter to the number average particle diameter of 1.50 or less are prepared. The mother toner particles in an amount of 100 parts are mixed with 0.5 parts of an additive HDK-2000 (from Clariant) and 0.5 parts of another additive H05TD (from Clariant) by a HENSCHEL MIXER. Thus, gold toners G1 to G17 are prepared. In Table 5-1, "Carnauba Wax" represents Carnauba Wax No. 1 from CERARICA NODA Co., Ltd., "Fatty Acid Amide" represents N,N'-ethylene-bis stearic acid amide, and "Gold Bronze Pigment" represents LITHOFLEX® XA 40 01 from ECKART.

TABLE 5-1

| Gold Toner | Polyester Resins | | | | | | Crystalline Polyester Resins | | Release Agents | | (part by weight) |
|---|---|---|---|---|---|---|---|---|---|---|---|
| No. | A1 | A2 | A3 | A4 | A5 | A6 | B1 | B2 | Carnauba wax (1) | Fatty acid amide (2) | Gold Bronze Pigment (3) |
| G1 | 100 | | | | | | | | 5 | | 20 |
| G2 | | 100 | | | | | | | 5 | | 20 |
| G3 | | | 100 | | | | | | 5 | | 20 |
| G4 | 80 | | | | | | 20 | | 5 | | 20 |
| G5 | 80 | | | | | | 20 | | 5 | 3 | 20 |
| G6 | 80 | | | | | | | 20 | 5 | 3 | 20 |
| G7 | 90 | | | | | | 10 | | 5 | 3 | 20 |
| G8 | | 80 | | | | | 20 | | 5 | 3 | 20 |
| G9 | | | 80 | | | | 20 | | 5 | 3 | 20 |
| G10 | | | | 80 | | | 20 | | 5 | 3 | 20 |
| G11 | | | 60 | | 20 | | 20 | | 5 | 3 | 20 |
| G12 | | | | 100 | | | | | 5 | | 20 |
| G13 | | | | | 100 | | | | 5 | | 20 |
| G14 | | | | | | 100 | | | 5 | | 20 |
| G15 | | | | | 80 | | 20 | | 5 | 3 | 20 |
| G16 | | | | | | 80 | 20 | | 5 | 3 | 20 |
| G17 | | | 40 | | 40 | | 20 | | 5 | 3 | 20 |

(1) Carnauba Wax No. 1 from CERARICA NODA Co., Ltd.
(2) N,N'-ethylene-bis stearic acid amide
(3) LITHOFLEX XA 40 01 from Eckart Preparation of Silver Toners The procedures for preparing the gold toners G1 to G17 are repeated except for replacing the gold bronze pigment LITHOFLEX® XA 40 01 (from ECKART) with an aluminum pigment LITHOFLEX® ST 01510 (from ECKART), as described in Table 5-2. Thus, silver toners S1 to S17 are prepared. In Table 5-2, "Carnauba Wax" represents Carnauba Wax No. 1 from CERARICA NODA Co., Ltd., "Fatty Acid Amide" represents N,N'-ethylene-bis stearic acid amide, and "Aluminum Pigment" represents LITHOFLEX® ST 01510 from ECKART.

Preparation of Pearlescent Toners

The procedures for preparing the gold toners G1 to G17 are repeated except for replacing the gold bronze pigment LITHOFLEX® XA 40 01 (from ECKART) with a mica pigment covered with a metal oxide TIMIRON® Super Silk (from Merck KGaA), as described in Table 5-2. Thus, pearlescent toners P1 to P17 are prepared. In Table 5-2, "Carnauba Wax" represents Carnauba Wax No. 1 from CERARICA NODA Co., Ltd., "Fatty Acid Amide" represents N,N'-ethylene-bis stearic acid amide, and "Mica Pigment" represents TIMIRON® Super Silk from Merck KGaA.

TABLE 5-2

(part by weight)

| Silver Toner | Polyester Resins | | | | | | Crystalline Polyester Resins | | Release Agents: Carnauba | Release Agents: Fatty acid | Aluminum |
|---|---|---|---|---|---|---|---|---|---|---|---|
| No. | A1 | A2 | A3 | A4 | A5 | A6 | B1 | B2 | wax (1) | amide (2) | Pigment (3) |
| S1 | 100 | | | | | | | | 5 | | 20 |
| S2 | | 100 | | | | | | | 5 | | 20 |
| S3 | | | 100 | | | | | | 5 | | 20 |
| S4 | 80 | | | | | | 20 | | 5 | | 20 |
| S5 | 80 | | | | | | 20 | | 5 | 3 | 20 |
| S6 | 80 | | | | | | | 20 | 5 | 3 | 20 |
| S7 | 90 | | | | | | 10 | | 5 | 3 | 20 |
| S8 | | 80 | | | | | 20 | | 5 | 3 | 20 |
| S9 | | | 80 | | | | 20 | | 5 | 3 | 20 |
| S10 | | | | 80 | | | 20 | | 5 | 3 | 20 |
| S11 | | | 60 | | 20 | | 20 | | 5 | 3 | 20 |
| S12 | | | | 100 | | | | | 5 | | 20 |
| S13 | | | | | 100 | | | | 5 | | 20 |
| S14 | | | | | | 100 | | | 5 | | 20 |
| S15 | | | | | 80 | | 20 | | 5 | 3 | 20 |
| S16 | | | | | | 80 | 20 | | 5 | 3 | 20 |
| S17 | | | 40 | | 40 | | 20 | | 5 | 3 | 20 |

(1) Carnauba Wax No. 1 from CERARICA NODA Co., Ltd.
(2) N,N'-ethylene-bis stearic acid amide
(3) LITHOFLEX ST 01510 from Eckart

TABLE 5-3

(part by weight)

| Pearlescent | Polyester Resins | | | | | | Crystalline Polyester Resins | | Release Agents: Carnauba | Release Agents: Fatty acid | Mica |
|---|---|---|---|---|---|---|---|---|---|---|---|
| Toner No. | A1 | A2 | A3 | A4 | A5 | A6 | B1 | B2 | wax (1) | amide (2) | Pigment (3) |
| P1 | 100 | | | | | | | | 5 | | 20 |
| P2 | | 100 | | | | | | | 5 | | 20 |
| P3 | | | 100 | | | | | | 5 | | 20 |
| P4 | 80 | | | | | | 20 | | 5 | | 20 |
| P5 | 80 | | | | | | 20 | | 5 | 3 | 20 |
| P6 | 80 | | | | | | | 20 | 5 | 3 | 20 |
| P7 | 90 | | | | | | 10 | | 5 | 3 | 20 |
| P8 | | 80 | | | | | 20 | | 5 | 3 | 20 |
| P9 | | | 80 | | | | 20 | | 5 | 3 | 20 |
| P10 | | | | 80 | | | 20 | | 5 | 3 | 20 |
| P11 | | | 60 | | 20 | | 20 | | 5 | 3 | 20 |
| P12 | | | | 100 | | | | | 5 | | 20 |
| P13 | | | | | 100 | | | | 5 | | 20 |
| P14 | | | | | | 100 | | | 5 | | 20 |
| P15 | | | | | 80 | | 20 | | 5 | 3 | 20 |
| P16 | | | | | | 80 | 20 | | 5 | 3 | 20 |
| P17 | | | 40 | | 40 | | 20 | | 5 | 3 | 20 |

(1) Carnauba Wax No. 1 from CERARICA NODA Co., Ltd.
(2) N,N'-ethylene-bis stearic acid amide
(3) TIMIRON ® Super Silk from Merck KGaA Preparation of Fluorescent Toners Each composition of polyester resins, crystalline polyester resins, release agents, and colorants at a ratio described in Table 6 are mixed by a HENSCHEL MIXER MF20C/I (from Nippon Coke & Engineering Co., Ltd.). The mixture is kneaded with a twin screw extruder (from Toshiba Machine Co., Ltd.). The kneaded mixture is cooled on a steel belt and pulverized into coarse particles of 200 to 300 μm by a hammer mill. The coarse particles are further pulverized into fine particles having a weight average particle diameter of 5.2±0.3 μm by an ultrasonic jet pulverizer LABOJET (from Nippon Pneumatic Mfg. Co., Ltd.) while controlling the pulverizing air pressure. The fine particles are subjected to a classification by an airflow classifier MDS-I (from Nippon Pneumatic Mfg. Co., Ltd.) while controlling the louver opening. Thus, mother toner particles having a weight average particle diameter of 6.0±0.2 μm and a ratio of the weight average particle diameter to the number average particle diameter of 1.20 or less are prepared. The mother toner particles in an amount of 100 parts are mixed with 1.0 part of an additive HDK-2000 (from Clariant) and 1.0 part of another additive H05TD (from Clariant) by a HENSCHEL MIXER. Thus, fluorescent toners F1 to F17 are prepared. In Table 6, "Carnauba Wax" represents Carnauba Wax No. 1 from CERARICA NODA Co., Ltd., "Fatty Acid Amide" represents N,N'-ethylene-bis stearic acid amide, and "Fluorescent Pigment" represents SX-1004 from SINLOIHI Co., Ltd.

TABLE 6

(part by weight)

| Fluorescent Toner No. | Polyester Resins A1 | A2 | A3 | A4 | A5 | A6 | Crystalline Polyester Resins B1 | B2 | Release Agents Carnauba wax (1) | Fatty acid amide (2) | Fluorescent Pigment (3) |
|---|---|---|---|---|---|---|---|---|---|---|---|
| F1 | 100 | | | | | | | | 5 | | 20 |
| F2 | | 100 | | | | | | | 5 | | 20 |
| F3 | | | 100 | | | | | | 5 | | 20 |
| F4 | 80 | | | | | | 20 | | 5 | | 20 |
| F5 | 80 | | | | | | 20 | | 5 | 3 | 20 |
| F6 | 80 | | | | | | | 20 | 5 | 3 | 20 |
| F7 | 90 | | | | | | 10 | | 5 | 3 | 20 |
| F8 | | 80 | | | | | 20 | | 5 | 3 | 20 |
| F9 | | | 80 | | | | 20 | | 5 | 3 | 20 |
| F10 | | | | 80 | | | 20 | | 5 | 3 | 20 |
| F11 | | | 60 | | 20 | | 20 | | 5 | 3 | 20 |
| F12 | | | | 100 | | | | | 5 | | 20 |
| F13 | | | | | 100 | | | | 5 | | 20 |
| F14 | | | | | | 100 | | | 5 | | 20 |
| F15 | | | | | 80 | | 20 | | 5 | 3 | 20 |
| F16 | | | | | | 80 | 20 | | 5 | 3 | 20 |
| F17 | | | 40 | | 40 | | 20 | | 5 | 3 | 20 |

(1) Carnauba Wax No. 1 from CERARICA NODA Co., Ltd.
(2) N,N'-ethylene-bis stearic acid amide
(3) SX-1004 from SINLOIHI Co., Ltd.

Measurement of Loss Tangent Peak Temperature and Value

The loss tangent peak temperatures and values of the toners are determined in the same manner as those of the polyester resins described above. The results are shown in Tables 7 to 10.

TABLE 7

| Toner No. | Loss Tangent Peak Temperature (° C.) | Loss Tangent Peak Value |
|---|---|---|
| W1 | 143 | 19 |
| W2 | 142 | 24 |

TABLE 7-continued

| Toner No. | Loss Tangent Peak Temperature (° C.) | Loss Tangent Peak Value |
|---|---|---|
| W3 | 87 | 15 |
| W4 | 134 | 19 |
| W5 | 136 | 18 |
| W6 | 142 | 20 |
| W7 | 140 | 17 |
| W8 | 134 | 18 |
| W9 | 84 | 14 |
| W10 | 159 | 12 |
| W11 | 134 | 3 |
| W12 | 139 | 17 |
| W13 | 134 | 19 |
| W14 | 145 | 19 |
| W15 | 135 | 19 |
| W16 | 137 | 18 |
| W17 | 134 | 3 |
| W18 | 162 | 5 |
| W19 | No Peak | — |
| W20 | 79 | 9 |
| W21 | No peak | — |
| W22 | 75 | 11 |
| W23 | 150 | 2 |
| W24 | 166 | 5 |
| W25 | 155 | 2 |

TABLE 8

| Toner No. | Loss Tangent Peak Temperature (° C.) | Loss Tangent Peak Value |
|---|---|---|
| Bk1 | 141 | 17 |
| Bk2 | 132 | 17 |
| Bk3 | 134 | 16 |
| Bk4 | 80 | 12 |
| Bk5 | 158 | 10 |
| Bk6 | 132 | 3 |
| Bk7 | 161 | 13 |
| Bk8 | No peak | — |
| Bk9 | 77 | 10 |

TABLE 8-continued

| Toner No. | Loss Tangent Peak Temperature (° C.) | Loss Tangent Peak Value |
|---|---|---|
| Bk10 | 148 | 1 |
| C1 | 141 | 16 |
| C2 | 132 | 17 |
| C3 | 133 | 16 |
| C4 | 81 | 13 |
| C5 | 159 | 11 |
| C6 | 134 | 3 |
| C7 | 162 | 13 |
| C8 | No peak | — |
| C9 | 76 | 11 |
| C10 | 148 | 2 |

TABLE 9-1

| Toner No. | Loss Tangent Peak Temperature (° C.) | Loss Tangent Peak Value |
|---|---|---|
| G1 | 141 | 20 |
| G2 | 140 | 25 |
| G3 | 86 | 16 |
| G4 | 132 | 20 |
| G5 | 134 | 19 |
| G6 | 140 | 21 |
| G7 | 138 | 18 |
| G8 | 133 | 19 |
| G9 | 83 | 15 |
| G10 | 157 | 12 |
| G11 | 133 | 3 |
| G12 | 161 | 6 |
| G13 | No peak | — |
| G14 | 78 | 10 |
| G15 | No peak | — |
| G16 | 74 | 13 |
| G17 | 149 | 2 |

TABLE 9-2

| Toner No. | Loss Tangent Peak Temperature (° C.) | Loss Tangent Peak Value |
|---|---|---|
| S1 | 142 | 19 |
| S2 | 141 | 25 |
| S3 | 86 | 15 |
| S4 | 133 | 20 |
| S5 | 135 | 19 |
| S6 | 141 | 21 |
| S7 | 139 | 18 |
| S8 | 133 | 19 |
| S9 | 83 | 14 |
| S10 | 158 | 12 |
| S11 | 133 | 3 |
| S12 | 161 | 6 |
| S13 | No peak | — |
| S14 | 78 | 10 |
| S15 | No peak | — |
| S16 | 74 | 12 |
| S17 | 150 | 2 |
| P1 | 142 | 20 |
| P2 | 142 | 25 |
| P3 | 87 | 16 |
| P4 | 133 | 19 |
| P5 | 134 | 19 |
| P6 | 141 | 20 |
| P7 | 139 | 17 |
| P8 | 134 | 19 |
| P9 | 84 | 15 |
| P10 | 158 | 13 |
| P11 | 134 | 3 |
| P12 | 162 | 6 |
| P13 | No peak | — |
| P14 | 79 | 10 |
| P15 | No peak | — |

TABLE 9-2-continued

| Toner No. | Loss Tangent Peak Temperature (° C.) | Loss Tangent Peak Value |
|---|---|---|
| P16 | 75 | 12 |
| P17 | 149 | 2 |

TABLE 10

| Toner No. | Loss Tangent Peak Temperature (° C.) | Loss Tangent Peak Value |
|---|---|---|
| F1 | 142 | 19 |
| F2 | 141 | 24 |
| F3 | 84 | 15 |
| F4 | 133 | 18 |
| F5 | 137 | 16 |
| F6 | 143 | 18 |
| F7 | 141 | 16 |
| F8 | 135 | 14 |
| F9 | 81 | 12 |
| F10 | 159 | 10 |
| F11 | 133 | 3 |
| F12 | 161 | 15 |
| F13 | No peak | — |
| F14 | 78 | 8 |
| F15 | No peak | — |
| F16 | 74 | 10 |
| F17 | 154 | 2 |

Preparation of Carrier

A mixture of 100 parts of a silicone resin (organo straight silicone), 100 parts of toluene, 5 parts of γ-(2-aminoethyl) aminopropyl trimethoxysilane, and 10 parts of a carbon black is subjected to a dispersion treatment for 20 minutes using a HOMOMIXER. Thus, a coating layer forming liquid is prepared.

The coating layer forming liquid is applied to Mn ferrite particles having a weight average particle diameter of 35 μm at 70° C. using a fluidized-bed-type coating device, followed by drying, so that the resulting coating layer has an average thickness of 0.20 μm. The ferrite particles having the coating layer are further burnt in an electric furnace at 180° C. for 2 hours. Thus, a carrier A is prepared.

Preparation of Two-Component Developers

Each of the above-prepared toners and the carrier A are uniformly mixed for 5 minutes at 48 rpm by TURBULA® MIXER (from Willy A. Bachofen AG) to prepare two-component developers. The toner concentration in each two-component developer is set to 4%.

Evaluation of Gloss

Each of the two-component developers is set in a digital full-color image forming apparatus IMAGIO NEO C600 (manufactured and modified by Ricoh Co., Ltd.) having a linear speed of 320 mm/sec. A 4 cm×4 cm solid image including toner in an amount of 0.4 mg/cm$^2$ is formed and fixed on a paper (POD gloss coat paper 128 g/m$^2$ from Oji Paper Co., Ltd.) at a temperature of 200° C. and a nip width of 15 mm. Ten randomly-selected portions on the fixed solid image are subjected to a measurement of 60° gloss by a glossmeter VGS-1D (from Nippon Denshoku Industries Co., Ltd.). The ten measured values are averaged.

The averaged 60° gloss values for the white, colored, and fluorescent toners are graded as follows.

A: not less than 85

B: not less than 80 and less than 85

C: not less than 50 and less than 80

D: less than 50

The averaged 60° gloss values for the metallic toners are graded as follows.

A: not less than 80

B: not less than 50 and less than 80

C: not less than 20 and less than 50

D: less than 20

Evaluation of Coloring Power for Colored Toners

Each of the two-component developers is set in a digital full-color image forming apparatus IMAGIO NEO C600 (manufactured and modified by Ricoh Co., Ltd.) having a linear speed of 320 mm/sec. A 4 cm×4 cm solid image including toner in an amount of 0.3 mg/cm$^2$ is formed and fixed on a paper (POD gloss coat paper 128 g/m$^2$ from Oji Paper Co., Ltd.) at a temperature of 200° C. and a nip width of 15 mm. Three randomly-selected portions on the fixed solid image are subjected to a measurement of image density by an X-RITE. The three measured values are averaged.

The averaged image density values for the colored toners are graded as follows.

A: not less than 1.40

B: not less than 1.35 and less than 1.40

C: not less than 1.20 and less than 1.35

D: less than 1.20

Evaluation of Coloring Power for White Toners

Each of the two-component developers is set in a digital full-color image forming apparatus IMAGIO NEO C600 (manufactured and modified by Ricoh Co., Ltd.) having a linear speed of 160 mm/sec. A 4 cm×4 cm solid image including toner in an amount of 1.0 mg/cm$^2$ is formed and fixed on an OHP sheet at a temperature of 200° C. and a nip width of 15 mm. Three randomly-selected portions on the fixed solid image are subjected to a measurement of black image density by an X-RITE with a black plate background. The three measured values are averaged. The greater the opacifying power of the white toner, the smaller the black image density.

The averaged black image density values for the white toners are graded as follows.

A: less than 0.12

B: not less than 0.12 and less than 0.14

C: not less than 0.14 and less than 0.16

D: not less than 0.16

Evaluation of Coloring Power for Metallic Toners

Each of the two-component developers is set in a digital full-color image forming apparatus IMAGIO NEO C600 (manufactured and modified by Ricoh Co., Ltd.) having a linear speed of 160 mm/sec. A 4 cm×4 cm solid image including toner in an amount of 1.0 mg/cm$^2$ is formed and fixed on an OHP sheet at a temperature of 200° C. and a nip width of 15 mm. Three randomly-selected portions on the fixed solid image are subjected to a measurement of black image density by an X-RITE with a black plate background. The three measured values are averaged. The greater the opacifying power of the metallic toner, the smaller the black image density.

The averaged black image density values for the metallic toners are graded as follows.

A: less than 0.12

B: not less than 0.12 and less than 0.14

C: not less than 0.14 and less than 0.16

D: not less than 0.16

Evaluation of Metallic Texture for Metallic Toners

Each of the two-component developers is set in a digital full-color image forming apparatus IMAGIO NEO C600 (manufactured and modified by Ricoh Co., Ltd.) having a linear speed of 320 mm/sec. A 4 cm×4 cm solid image including toner in an amount of 0.4 mg/cm$^2$ is formed and fixed on a paper (POD gloss coat paper 128 g/m$^2$ from Oji Paper Co., Ltd.) at a temperature of 200° C. and a nip width of 15 mm. The fixed solid image is visually observed to evaluate metallic texture.

The metallic texture for the metallic toners is graded into three levels: high, middle, and low.

Evaluation of Coloring Power for Fluorescent Toners

Each of the two-component developers is set in a digital full-color image forming apparatus IMAGIO NEO C600 (manufactured and modified by Ricoh Co., Ltd.) having a linear speed of 320 mm/sec. A 4 cm×4 cm solid image including toner in an amount of 0.3 mg/cm$^2$ is formed and fixed on a paper (POD gloss coat paper 128 g/m$^2$ from Oji Paper Co., Ltd.) at a temperature of 200° C. and a nip width of 15 mm. Three randomly-selected portions on the fixed solid image are subjected to a measurement of image density by an X-RITE. The three measured values are averaged.

The averaged image density values for the fluorescent toners are graded as follows.

A: not less than 1.40

B: not less than 1.35 and less than 1.40

C: not less than 1.20 and less than 1.35

D: less than 1.20

Evaluation of Opacifying Power for Fluorescent Toners

Each of the two-component developers is set in a digital full-color image forming apparatus IMAGIO NEO C600 (manufactured and modified by Ricoh Co., Ltd.) having a linear speed of 160 mm/sec. A 4 cm×4 cm solid image including toner in an amount of 1.0 mg/cm$^2$ is formed and fixed on an OHP sheet at a temperature of 200° C. and a nip width of 15 mm. Three randomly-selected portions on the fixed solid image are subjected to a measurement of black image density by an X-RITE with a black plate background. The three measured values are averaged. The greater the opacifying power of the fluorescent toner, the smaller the black image density.

The averaged black image density values for the fluorescent toners are graded as follows.

A: less than 0.12

B: not less than 0.12 and less than 0.14

C: not less than 0.14 and less than 0.16

D: not less than 0.16

Evaluation of Fluorescent Texture

Each of the two-component developers is set in a digital full-color image forming apparatus IMAGIO NEO C600 (manufactured and modified by Ricoh Co., Ltd.) having a linear speed of 320 mm/sec. A 4 cm×4 cm solid image including toner in an amount of 0.4 mg/cm$^2$ is formed and fixed on a paper (POD gloss coat paper 128 g/m$^2$ from Oji Paper Co., Ltd.) at a temperature of 200° C. and a nip width of 15 mm. The fixed solid image is visually observed to evaluate fluorescent texture.

The fluorescent texture for the fluorescent toners is graded into two levels: good and poor.

Evaluation of Cold Offset Resistance

Each of the two-component developers is set in a super high-speed digital laser printer IPSIO SP9500Pro (from Ricoh Co., Ltd.). A 1 cm×1 cm solid image including toner in an amount of 0.20±0.1 mg/cm$^2$ is formed and fixed on a thick paper (<135> from NBS Ricoh) and subjected to a measurement of image density (ID1). A SCOTCH® mending tape 810 having a width of 24 mm (from 3M) is applied to the solid image and a metallic SUS roller having a weight of 1 kg and a diameter of 50 mm is loaded on the tape while rolling back and forth for 10 times at a speed of 10 mm/s. Thereafter, the tape is removed from the solid image in a predetermined direction at a speed of 10 mm/s and the solid image is subjected to a measurement of image density (ID2). The image residual ratio (%) is calculated from the following formula (1) and cold offset resistance is graded into the following four levels in terms of image residual ratio.

$$\text{Image Residual Ratio (\%)} = ID2/ID1 \times 100 \quad (1)$$

A: Image residual ratio is not less than 97%.

B: Image residual ratio is not less than 92% and less than 97%.

C: Image residual ratio is not less than 80% and less than 92%. (comparable with conventional toners)

D: Image residual ratio is less than 80%.

Evaluation of Hot Offset Resistance

Each of the two-component developers is set in a super high-speed digital laser printer IPSIO SP9500Pro (from Ricoh Co., Ltd.). A 1 cm×1 cm solid image including toner in an amount of 0.40±0.1 mg/cm$^2$ is formed on a thin paper (<55> from NBS Ricoh) and fixed thereon while varying the fixing roller temperature. The fixed solid images are visually observed to determine the maximum fixable temperature above which hot offset occurred. Hot offset resistance is graded into the following four levels in terms of maximum fixable temperature.

A: Maximum fixable temperature is not less than 240° C.

B: Maximum fixable temperature is not less than 220° C. and less than 240° C.

C: Maximum fixable temperature is not less than 180° C. and less than 220° C. (comparable with conventional toners)

D: Maximum fixable temperature is less than 180° C.

Evaluation of Heat-resistant Storage Stability

Heat-resistant storage stability is determined using a penetrometer (from Nikka Engineering Co., Ltd.) as follows. Each of the toners in an amount of 10 g is contained in a 30-ml glass screw vial under a condition 20-25° C., 40-60% RH. After being tapped for 200 times, the vial is let stand in a constant-temperature chamber at 50° C. for 48 hours. Thereafter, the toner is subjected to a measurement of penetration by the penetrometer. Heat-resistant storage stability is graded into the following four levels in terms of penetration. The greater the penetration, the better the heat-resistant storage stability.

A: Penetration is not less than 30 mm.

B: Penetration is 20 to 29 mm.

C: Penetration is 15 to 19 mm. (comparable with conventional toners)

D: Penetration is 8 to 14 mm.

E: Penetration is 7 mm or less.

Second Evaluation of Gloss for White and Colored Toners

Each of the two-component developers is set in a digital full-color image forming apparatus IMAGIO NEO C600 (manufactured and modified by Ricoh Co., Ltd.) having a linear speed of 160 mm/sec. A solid image including toner in an amount of 0.4 mg/cm$^2$ is formed overlying a white solid image including a white toner in an amount of 0.8 mg/cm$^2$ formed on a paper (POD gloss coat paper 128 g/m$^2$ from Oji Paper Co., Ltd.), and fixed thereon at a temperature of 200° C. and a nip width of 15 mm. Ten randomly-selected portions on the fixed solid image are subjected to a measurement of 60° gloss by a glossmeter VGS-1D (from Nippon Denshoku Industries Co., Ltd.). The ten measured values are averaged.

The averaged 60° gloss values for the white and colored toners are graded as follows.

A: not less than 85

B: not less than 80 and less than 85

C: not less than 50 and less than 80

D: less than 50

TABLE 11

| | Toner No. | Gloss | Coloring Power | Cold Offset Resistance | Hot Offset Resistance | Heat-resistant Storage Stability | Gloss ($2^{nd}$) |
|---|---|---|---|---|---|---|---|
| Examples | W1 | B | B | C | B | B | B |
| | W2 | B | B | C | B | B | B |
| | W3 | B | B | B | C | C | B |
| | W4 | A | A | B | B | B | A |
| | W5 | A | A | B | B | A | A |
| | W6 | A | A | B | B | A | A |
| | W7 | A | A | B | B | A | A |
| | W8 | A | A | B | B | A | A |
| | W9 | A | A | B | C | B | A |
| | W10 | B | B | C | B | B | B |
| | W11 | C | B | B | B | B | C |
| | W12 | C | B | B | B | A | C |
| | W13 | A | C | B | B | A | A |
| | W14 | B | C | C | B | B | B |
| | W15 | A | B | B | B | B | A |
| | W16 | A | B | B | B | A | A |
| | W17 | C | C | B | B | A | C |
| Comparative Examples | W18 | C | C | D | B | B | C |
| | W19 | D | D | D | B | B | D |
| | W20 | B | B | B | D | D | B |
| | W21 | D | D | D | B | B | D |
| | W22 | B | B | B | D | D | B |
| | W23 | D | D | C | B | B | D |
| | W24 | C | C | D | B | B | C |
| | W25 | D | D | C | B | B | D |

TABLE 12

| | Toner No. | Gloss | Coloring Power | Cold Offset Resistance | Hot Offset Resistance | Heat-resistant Storage Stability | Gloss ($2^{nd}$) |
|---|---|---|---|---|---|---|---|
| Examples | Bk1 | B | B | C | B | B | B |
| | Bk2 | A | A | B | B | B | A |
| | Bk3 | A | A | B | B | A | A |
| | Bk4 | A | A | B | C | B | A |
| | Bk5 | B | B | C | B | B | B |
| | Bk6 | C | C | B | B | B | C |
| Comparative Examples | Bk7 | C | C | D | B | B | C |
| | Bk8 | D | D | D | B | B | D |
| | Bk9 | B | B | B | D | D | B |
| | Bk10 | D | D | C | B | B | D |
| Examples | C1 | B | B | C | B | B | B |
| | C2 | A | A | B | B | B | A |
| | C3 | A | A | B | B | A | A |
| | C4 | A | A | B | C | B | A |
| | C5 | B | B | C | B | B | B |
| | C6 | C | C | B | B | B | C |
| Comparative Examples | C7 | C | C | D | B | B | C |
| | C8 | D | D | D | B | B | D |
| | C9 | B | B | B | D | D | B |
| | C10 | D | D | C | B | B | D |

TABLE 13-1

| | Toner No. | Gloss | Coloring Power | Metallic Texture | Cold Offset Resistance | Hot Offset Resistance | Heat-resistant Storage Stability |
|---|---|---|---|---|---|---|---|
| Examples | G1 | B | B | High | C | B | B |
| | G2 | B | B | High | C | B | B |
| | G3 | B | B | High | B | C | C |
| | G4 | A | A | High | B | B | C |
| | G5 | A | A | High | B | B | B |
| | G6 | A | A | High | B | B | B |
| | G7 | A | A | High | B | B | B |
| | G8 | A | A | High | B | B | B |
| | G9 | A | A | High | B | C | C |

TABLE 13-1-continued

| | Toner No. | Gloss | Coloring Power | Metallic Texture | Cold Offset Resistance | Hot Offset Resistance | Heat-resistant Storage Stability |
|---|---|---|---|---|---|---|---|
| Comparative Examples | G10 | B | B | High | C | B | B |
| | G11 | C | B | Middle | B | B | B |
| | G12 | C | C | Middle | D | B | B |
| | G13 | D | C | Low | D | B | B |
| | G14 | B | B | High | B | D | D |
| | G15 | D | C | Low | D | B | B |
| | G16 | B | B | High | B | D | E |
| | G17 | D | C | Low | C | B | B |

TABLE 13-2

| | Toner No. | Gloss | Coloring Power | Metallic Texture | Cold Offset Resistance | Hot Offset Resistance | Heat-resistant Storage Stability |
|---|---|---|---|---|---|---|---|
| Examples | S1 | B | B | High | C | B | B |
| | S2 | B | B | High | C | B | B |
| | S3 | B | B | High | B | C | C |
| | S4 | A | A | High | B | B | C |
| | S5 | A | A | High | B | B | B |

TABLE 13-2-continued

| | Toner No. | Gloss | Coloring Power | Metallic Texture | Cold Offset Resistance | Hot Offset Resistance | Heat-resistant Storage Stability |
|---|---|---|---|---|---|---|---|
| Comparative Examples | S6 | A | A | High | B | B | B |
| | S7 | A | A | High | B | B | B |
| | S8 | A | A | High | B | B | B |
| | S9 | A | A | High | B | C | C |
| | S10 | B | B | High | C | B | B |
| | S11 | C | B | Middle | B | B | B |
| | S12 | C | C | Middle | D | B | B |
| | S13 | D | C | Low | D | B | B |
| | S14 | B | B | High | B | D | D |
| | S15 | D | C | Low | D | B | B |
| | S16 | B | B | High | B | D | E |
| | S17 | D | C | Low | C | B | B |

TABLE 13-3

| | Toner No. | Gloss | Coloring Power | Metallic Texture | Cold Offset Resistance | Hot Offset Resistance | Heat-resistant Storage Stability |
|---|---|---|---|---|---|---|---|
| Examples | P1 | B | B | High | C | B | B |
| | P2 | B | B | High | C | B | B |
| | P3 | B | B | High | B | C | C |
| | P4 | A | A | High | B | B | C |
| | P5 | A | A | High | B | B | B |
| | P6 | A | A | High | B | B | B |
| | P7 | A | A | High | B | B | B |
| | P8 | A | A | High | B | B | B |
| | P9 | A | A | High | B | C | C |
| | P10 | B | B | High | C | B | B |
| | P11 | C | B | Middle | B | B | B |
| Comparative Examples | P12 | C | C | Middle | D | B | B |
| | P13 | D | C | Low | D | B | B |
| | P14 | B | B | High | B | D | D |
| | P15 | D | C | Low | D | B | B |
| | P16 | B | B | High | B | D | D |
| | P17 | D | C | Low | C | B | B |

TABLE 14

| | Toner No. | Gloss | Coloring Power | Opacifying Power | Fluorescent Texture | Cold Offset Resistance | Hot Offset Resistance | Heat-resistant Storage Stability |
|---|---|---|---|---|---|---|---|---|
| Examples | F1 | B | B | B | Good | C | B | B |
| | F2 | B | B | B | Good | C | B | B |
| | F3 | B | B | B | Good | B | C | C |
| | F4 | A | A | A | Good | B | B | B |
| | F5 | A | A | A | Good | B | B | A |
| | F6 | A | A | A | Good | B | B | A |
| | F7 | A | A | A | Good | B | B | A |
| | F8 | A | A | A | Good | B | B | A |
| | F9 | A | A | A | Good | B | C | B |
| | F10 | B | B | B | Good | C | B | B |
| | F11 | C | B | B | Good | B | B | B |
| Comparative Examples | F12 | C | C | C | Poor | D | B | B |
| | F13 | D | D | D | Poor | D | B | B |
| | F14 | B | B | B | Poor | B | D | D |
| | F15 | D | D | D | Poor | D | B | B |
| | F16 | B | B | B | Poor | B | D | D |
| | F17 | D | D | D | Poor | C | B | B |

Additional modifications and variations of the present invention are possible in light of the above teachings. It is therefore to be understood that within the scope of the appended claims the invention may be practiced other than as specifically described herein.

What is claimed is:

1. A toner, comprising:

a binder resin, wherein the binder resin comprises a crystalline polyester resin;

a colorant; and a release agent, wherein the release agent comprises a fatty acid amide, wherein the toner has a peak loss tangent (tan δ) value of 3 or more within a temperature range of 80 to 160° C., the loss tangent (tan δ) being a ratio (G"/G') of a loss elastic modulus (G") to a storage elastic modulus (G').

2. The toner according to claim 1, wherein the fatty acid amide includes N,N'-ethylene-bis stearic acid amide.

3. The toner according to claim 1, wherein the colorant is a white pigment.

4. The toner according to claim 3, wherein the white pigment is an organic white pigment.

5. The toner according to claim 4, wherein the organic white pigment is N,N-bis(4,6-1,3,5-triazine-2-yl) ethylenediamine.

6. The toner according to claim 3, wherein the toner includes the white pigment in an amount of 10 to 70% by weight.

7. The toner according to claim 1, wherein the colorant is a magenta pigment.

8. The toner according to claim 1, wherein the colorant is a cyan pigment.

9. The toner according to claim 1, wherein the colorant is a yellow pigment.

10. The toner according to claim 1, wherein the colorant is a black pigment.

11. The toner according to claim 1, wherein the colorant is a metallic pigment.

12. The toner according to claim 11, wherein the metallic pigment is a gold bronze pigment.

13. The toner according to claim 11, wherein the metallic pigment is an aluminum pigment.

14. The toner according to claim 11, wherein the metallic pigment is a mica pigment covered with a metal oxide.

15. The toner according to claim 1, wherein the colorant is a fluorescent colorant.

16. An electrophotographic image forming method, comprising:

charging an image bearing member;

irradiating the charged image bearing member with light containing image information to form an electrostatic latent image is thereon;

developing the electrostatic latent image into a toner image with the toner according to claim 1;

transferring the toner image from the image bearing member onto a recording medium; and fixing the toner image on the recording medium.

* * * * *